US007437093B2

(12) United States Patent
Kushida et al.

(10) Patent No.: US 7,437,093 B2
(45) Date of Patent: Oct. 14, 2008

(54) SHEET-PROCESSING SYSTEM

(75) Inventors: Hideki Kushida, Ibaraki (JP); Tomokazu Nakamura, Chiba (JP); Akihiro Sato, Kanagawa (JP); Akihiro Shimizu, Chiba (JP); Tatsuya Goto, Chiba (JP); Katsuaki Hirai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 11/468,660

(22) Filed: Aug. 30, 2006

(65) Prior Publication Data

US 2006/0285869 A1 Dec. 21, 2006

Related U.S. Application Data

(63) Continuation of application No. 10/965,521, filed on Oct. 14, 2004, now Pat. No. 7,120,373.

(30) Foreign Application Priority Data

Oct. 16, 2003 (JP) ..... 2003-356739

(51) Int. Cl.
*G03G 15/00* (2006.01)

(52) U.S. Cl. ..... 399/81; 399/82; 399/407

(58) Field of Classification Search ..... 399/81, 399/82, 407

See application file for complete search history.

(56) References Cited

U.S. PATENT DOCUMENTS

| | | | | | |
|---|---|---|---|---|---|
| 5,053,831 | A | * | 10/1991 | Ishiguro et al. | 399/410 X |
| 5,590,871 | A | * | 1/1997 | Okabe et al. | 399/410 X |
| 5,669,040 | A | * | 9/1997 | Hisatake | 399/83 |
| 5,878,302 | A | | 3/1999 | Inui et al. | |
| 6,430,382 | B1 | | 8/2002 | Okamoto et al. | |
| 6,433,880 | B1 | | 8/2002 | Nishikata et al. | |

FOREIGN PATENT DOCUMENTS

| | | | |
|---|---|---|---|
| JP | 62210481 | A | 9/1987 |
| JP | 2003-089473 | A | 3/2003 |

* cited by examiner

*Primary Examiner*—David M Gray
*Assistant Examiner*—Erika J. Villaluna
(74) *Attorney, Agent, or Firm*—Canon U.S.A., Inc. I.P. Division

(57) ABSTRACT

A sheet-processing system can perform a plurality of jobs in parallel. While process 1 and process 2 are being processed simultaneously, a job display screen is segmented into two such that segmented job display screens for process 1 and process 2 are simultaneously displayed in a touch panel display frame of an operation display. Accordingly, the operation display in the sheet-processing system exhibits good visibility.

12 Claims, 37 Drawing Sheets

SHEET-PROCESSING SYSTEM

This application is a continuation of U.S. application Ser. No. 10/965,521, filed on Nov. 14, 2004, entitled "Sheet-Processing System", which claims the benefit of Japanese Patent Application No. 2003-356739, filed Oct. 16, 2003, the contents of which both preceding applications are expressly incorporated by reference herein in its entirety.

BACKGROUND OF THE INVENTION

1. Field of the Invention

The present invention relates to a sheet-processing system capable of simultaneously performing a plurality of jobs such as binding or stacking of sheets on which images are formed, by arbitrarily combining a plurality of sheet-processing devices having individual sheet-processing functions such as forming an image onto a sheet, inserting a cover or tab, or stapling aligned sheets in a bundle.

2. Description of the Related Art

A sheet-processing system of a type having an image formation device such as a copier including a sequentially connected stacker, inserter, and finisher has been provided. The image formation device forms images onto sheets and outputs them, the stacker temporarily holds sheets, the inserter inserts special-purpose paper such as a front cover or tab, into the top or middle of sheets, and the finisher aligns and binds a plurality of sheets. With this sheet-processing system, after images are formed onto the sheets, various processes such as insertion of special-purpose paper, ejecting, folding, stapling, binding, or punching can be performed on the sheets.

FIG. 37 illustrates a sheet-processing system of a known type. The sheet-processing system includes an image formation device 1, a stacker 50, an inserter 60, and a finisher 70, which are arranged next to each other in this order. The stacker 50 temporarily holds sheets on which images are formed at the image formation device 10. The inserter 60 inserts special-purpose paper for a front cover or tab, e.g., color copy paper, into the top or middle of the sheets output from the image formation device 1. The finisher 70 aligns and binds the sheets output from the image formation device 1 or the inserter 60 and staples the sheets together. The sheet-processing system also includes a common path 90 indicated by the hatching in the drawing. This path 90 lies across the stacker 50, the inserter 60, and the finisher 70. Some of the aforementioned techniques may be found, for example, in Japanese Patent Laid-Open No. 2003-89473.

In the sheet-processing system, those devices are arbitrarily combined to perform a job, which is a unit for sheet processing. For instance, the finisher 70 aligns and staples sheets together with images formed in the image formation device 1, along with special-purpose paper such as a front cover or tab that is inserted by the inserter 60, thereby binding all the sheets together. These different tasks are executed as one job.

Furthermore, with a known image formation device, when a plurality of copy jobs is performed in series, one copy job is displayed on the entire display frame of an operation display (display) at a time so that the screen has to be switched to monitor each copy job (some of these techniques may be found, for example, in Japanese Patent Laid-Open No. 11-212406).

Moreover, with the known sheet-processing system, while one job is processed, no other jobs can be executed simultaneously.

More specifically, while a job for stacking sheets using the image formation device 1 and the stacker 50 is processed, other jobs such as binding with the inserter 60 and the finisher 70 cannot be performed, even though the inserter 60 and the finisher 70 are not in use in the stacking job. Accordingly, each device cannot be fully utilized at the same time. Thus, the general efficiency of the sheet-processing system is deteriorated, resulting in decreased productivity.

Assuming that a number of jobs are simultaneously performed in the sheet-processing system and a display screen using the entire display frame is switched between jobs as in the sheet-processing system described in Japanese Patent Laid-Open No. 11-212406, a user cannot monitor all the jobs, which are simultaneously performed, in one display screen. Specifically, since a number of users may share one sheet-processing system, an improvement in the visibility of the operation display is necessary, so that the users do not misunderstand the status of the jobs processed in parallel.

SUMMARY OF THE INVENTION

It is an aspect of the present invention to provide a sheet-processing system in which a plurality of jobs are simultaneously displayed in a display frame through display segmentation during parallel processing of the plurality of jobs, whereby the display provides superior visibility.

According to an aspect of the present invention, a sheet-processing system is provided which includes a plurality of sheet-processing devices having sheet-processing functions; controllers for executing a job per unit for sheet processing with at least one of the sheet-processing devices; and a display having a single display frame and displaying a job display screen. In the sheet-processing system, when a plurality of jobs are processed in parallel, the job display screen is segmented in accordance with the number of jobs being processed in parallel, whereby segmented job display screens for the plurality of jobs are displayed simultaneously in the display frame.

As described above, in the sheet-processing system of the present invention, when the plurality of jobs are processed in parallel, the job display screen is segmented in accordance with the number of jobs being processed in parallel, whereby the segmented job display screens for the plurality of jobs are displayed simultaneously in the touch panel display frame of the display. Hence, a user can monitor the status of the both jobs simultaneously processed on the segmented job display screens in the display frame at the same time so that the sheet-processing system of the present invention exhibits excellent visibility.

Furthermore, other aspects, features, and advantages of the invention will become more apparent from the following detailed description taken in conjunction with the accompanying drawings.

DESCRIPTION OF THE PREFERRED EMBODIMENTS

Figure 1:
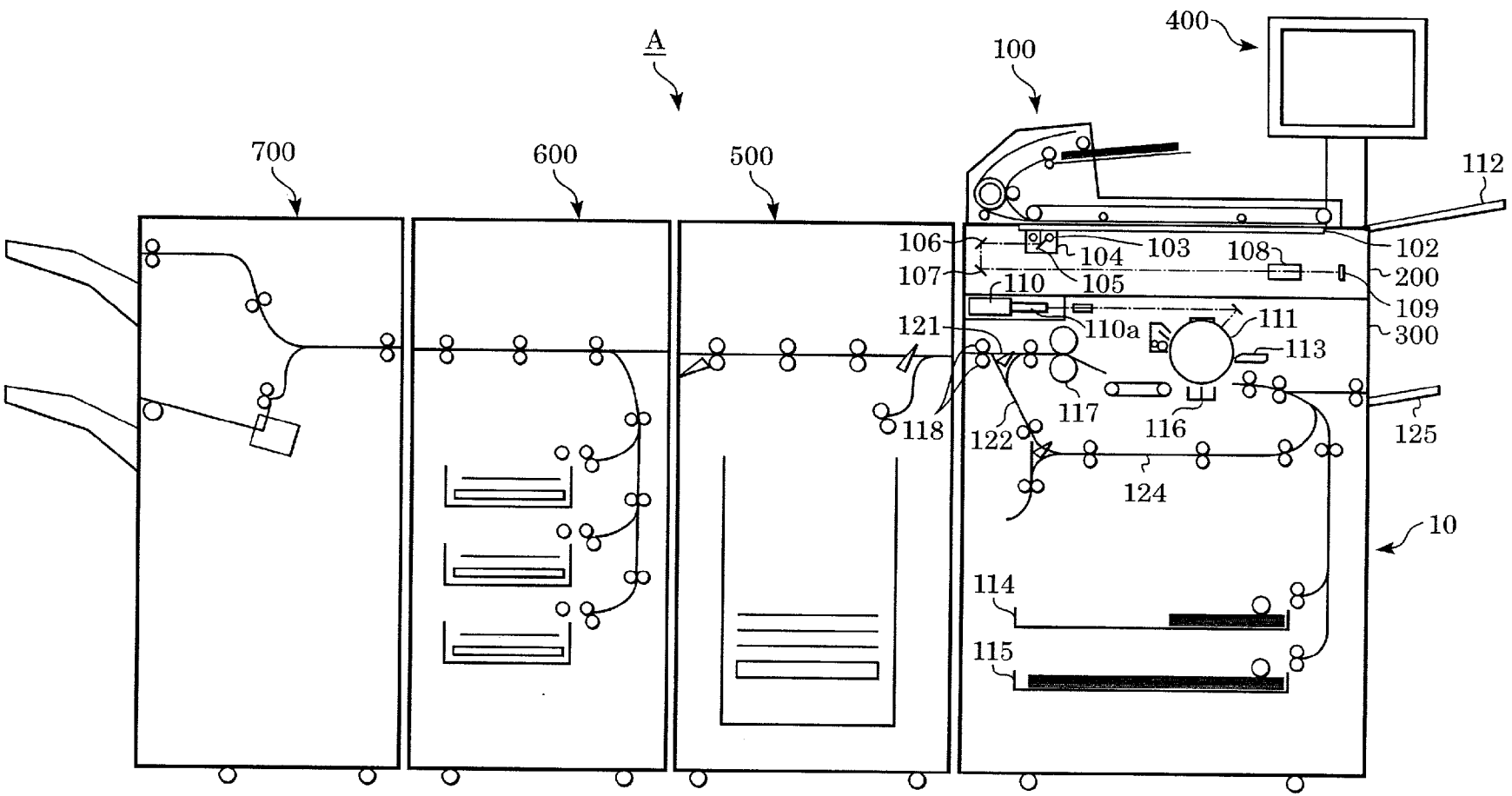
FIG. 1 is a schematic view of a sheet-processing system according to an embodiment of the present invention, showing the interior of the system.

The present invention will now be described in detail below with reference to the accompanying drawings showing a preferred embodiment thereof. In the drawings, elements and parts which are identical through out the views are designated by identical reference numeral, and duplicate description thereof is omitted.

FIG. 1 is a schematic view of the inner structure of a sheet-processing system according to an embodiment of the present invention. A sheet-processing system A of the present embodiment includes an image formation device 10, a stacker 500, an inserter 600, and a finisher 700. These devices are connected in series in this order and have different sheet-processing functions.

The image formation device 10 reads documents and forms images on sheets. The image formation device 10 includes a printer 300, an image reader 200, a document feeder 100, an operation display or display 400. The printer 300 forms images onto sheets. The image reader 200 is disposed on top of the printer 300 and reads the images of documents. The document feeder 100 is openably disposed on the image reader 200. The operation display 400 is disposed above the image reader 200.

A plurality of documents is placed on a document tray, facing up. The document feeder 100 separates the documents one-by-one from the foremost sheet and transfers the documents through a U-shaped path to a position where the document image is read (referred to as an image-reading position below) in the image reader 200. The image reader 200, in turn, reads the images of the running documents. Thereafter, the documents are ejected onto an ejection tray 112 disposed on the right side of the document feeder 100.

The image reader 200 reads the images of the documents. The image reader 200 has a platen glass 102 on top of the image reader 200 and has a scanner unit 104 below the platen glass 102. The scanner unit 104 reads the images of the documents transferred from the document feeder 100 to the image-reading position on the platen glass 102.

The image of the running document is read in the following manner. When a document passes through the image-reading position on the platen glass 102, the face of the document to be read is illuminated with light from a lamp 103 provided in the scanner unit 104, and the reflected light from the document is guided to an image sensor 109 via a mirror 105 disposed in the sequential scanner unit 104 and mirrors 106 and 107 disposed in the image reader 200. Then, the image sensor 109 converts the light into an electric signal. More specifically, the document is transferred across the image-reading position on the platen glass 102 from left to right in the drawing. The direction along which the document is transferred is a sub-scanning direction and the direction orthogonal to the sub-scanning direction is a main-scanning direction. The image sensor 109 reads every line of the image of the document in the main-scanning direction, and the sequential image sensor 109 reads the image of the document in the sub-scanning direction, thereby reading the entire image of the document. After that, a predetermined image process is conducted on the image data output from the image sensor 109, and the resulting image data is input to the printer 300 as a video signal.

The printer 300 forms an image on a sheet in accordance with the image of the document read by the image reader 200. The printer 300 includes an exposure controller 110, a photosensitive drum 111, a polygon mirror 110*a*, cassettes 114 and 115, a manual-feed tray 125, a two-sided transfer path 124, a fixing unit 117, and eject rollers 118. The video signal in accordance with the image data output from the image sensor 109 is input to the exposure controller 110 and the exposure controller 110 modulates and outputs laser beams in response to the video signal. The photosensitive drum 111 generates a latent image. The laser light output from the exposure controller 110 is scanned and irradiated onto the photosensitive drum 111 by the polygon mirror 110*a*. The cassettes 114 and 115 supply sheets to a transferring unit 116 disposed below the photosensitive drum 111. A developed image formed on the photosensitive drum 111 is transferred to a sheet at the transferring unit 116, and the fixing unit 117 fixes the developed image onto the sheet. Passing through the fixing unit 117, the sheet are ejected outside the printer 300 by the eject rollers 118.

Figure 2:
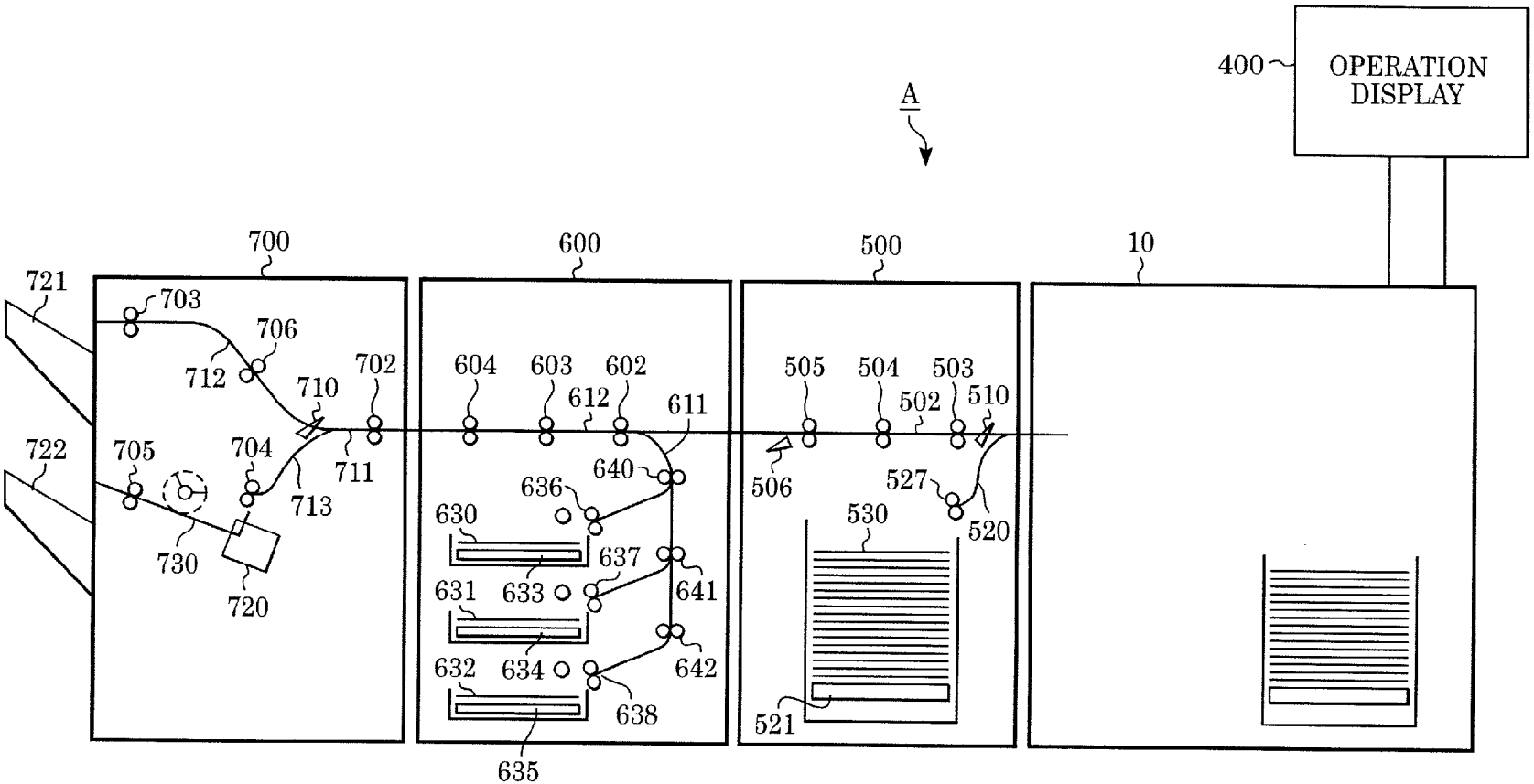
FIG. 2 is a schematic view of the sheet-processing system according to the embodiment, showing the interior of the system.

FIG. 2 is a schematic view of the inner structures of the stacker 500, the inserter 600, and the finisher 700 in the sheet-processing system of the present embodiment.

[Stacker 500]

The stacker 500 temporarily holds sheets output from the printer 300. As shown in FIG. 2, the stacker 500 includes a horizontal transfer path 502, transfer rollers 503, 504, and 505, a first flapper 510, a second flapper 506, a stacking unit 530, and a transfer path 520. The horizontal transfer path 502 guides the sheets ejected from the printer 300 to the inserter 600 and the finisher 700. The transfer rollers 503, 504, and 505 disposed on the horizontal transfer path 502 transfer the sheets. The first flapper 510 is disposed at the entrance of the horizontal transfer path 502 in the vicinity of the printer 300. The second flapper 506 is disposed at the exit of the horizontal transfer path 502 in the vicinity of the finisher 700. The sheets ejected from the printer 300 onto a stacking plate 521 can be stored in the stacking unit 530. The transfer path 520 guides the sheets ejected from the printer 300 to the stacking unit 530.

When the stacker 500 performs a stacking process such as sorting or grouping, the first flapper 510 is switched such that the sheets are prevented from entering the horizontal transfer path 502. Accordingly, the sheets ejected from the printer 300 are led to the transfer path 520 and stacked sequentially in the stacking unit 530.

When the sheets are not to be stacked in the stacking unit 530, the first flapper 510 is switched such that the sheets are prevented from entering the transfer path 520. Accordingly, the sheets ejected from the printer 300 pass along the horizontal transfer path 502 towards the inserter 600 and the finisher 700.

[Inserter 600]

The inserter 600 supplies special-purpose paper, which is previously printed, such as color copy paper, or inserts special-purpose paper such as a front cover or tab into the top or middle of the sheets output from the printer 300. As shown in FIG. 2, the inserter 600 includes a horizontal transfer path 612, transfer rollers 602, 603, and 604, sheet-accommodating units 630, 631, and 632, inner plates 633, 634, and 635, sheet-separating units 636, 637, and 638, a vertical transfer path 611 and transfer rollers 640, 641, and 642. The horizontal transfer path 612 leads the sheets from the transfer rollers 505 to the finisher 700. The transfer rollers 602, 603, and 604 are disposed on the horizontal transfer path 612. The sheet-accommodating units 630, 631, and 632 hold special-purpose paper such as a front cover or tab. The special-purpose paper is stacked on the inner plates 633, 634, and 635 in the sheet-accommodating units 630, 631, and 632. The sheet-separating units 636, 637, and 638 transfer the special-purpose paper stacked in the sheet-accommodating units 630, 631, and 632 to the horizontal transfer path 612. The vertical transfer path 611 leads the special-purpose paper from the sheet-accommodating units 630, 631, and 632 to the horizontal transfer path 612. The transfer rollers 640, 641, and 642 are disposed on the vertical transfer path 611.

The inserter 600 inserts the special-purpose paper stacked in the sheet-accommodating units 630, 631, and 632 into the sheets output from the printer 300 at a predetermined timing upon request. The inner plates 633, 634, and 635 ascend or descend in accordance with the amount of stacked sheets.

[Finisher 700]

The finisher 700 performs sorting, stapling, punching and the like. As shown in FIG. 2, the finisher 700 includes a finisher path 711, entrance rollers 702, a non-sort path 712, a sort path 713, a flapper 710, an intermediate tray 730, a stapler 720, and a stack tray 722. The finisher path 711 and the entrance rollers 702 lead the sheets output from the inserter 600. The non-sort path 712 transfers the sheets output from the inserter 600 to a sample tray 721 without sorting them. The sort path 713 transfers the sheets output from the inserter 600 to a sorting unit. A flapper 710 switches between the non-sort path 712 and the sort path 713. Sorting or stapling is performed on the intermediate tray 730. The stapler 720 staples the aligned sheets on the intermediate tray 730. The sheets sorted or stapled on the intermediate tray 730 are ejected to the stack tray 722.

When sorting is not performed, the flapper 710 is switched such that the sheets are prevented from entering the sort path 713. The sheets output from the inserter 600 are led to the non-sort path 712 and ejected onto the sample tray 721 through transfer rollers 706 and non-sort eject rollers 703.

When sorting is performed, the flapper 710 is switched such that the sheets are prevented from entering the non-sort path 712. The sort path 713 leads the sheets output from the inserter 600 to the intermediate tray 730 through sort eject rollers 704, and the sheets are stacked on the intermediate tray 730. The sheets stacked on the intermediate tray 730 are aligned, stapled or punched, as necessary, and are ejected onto the stack tray 722 through eject rollers 705. The stack tray 722 can move vertically.

[Structure of Outer Covers]

Figure 3:
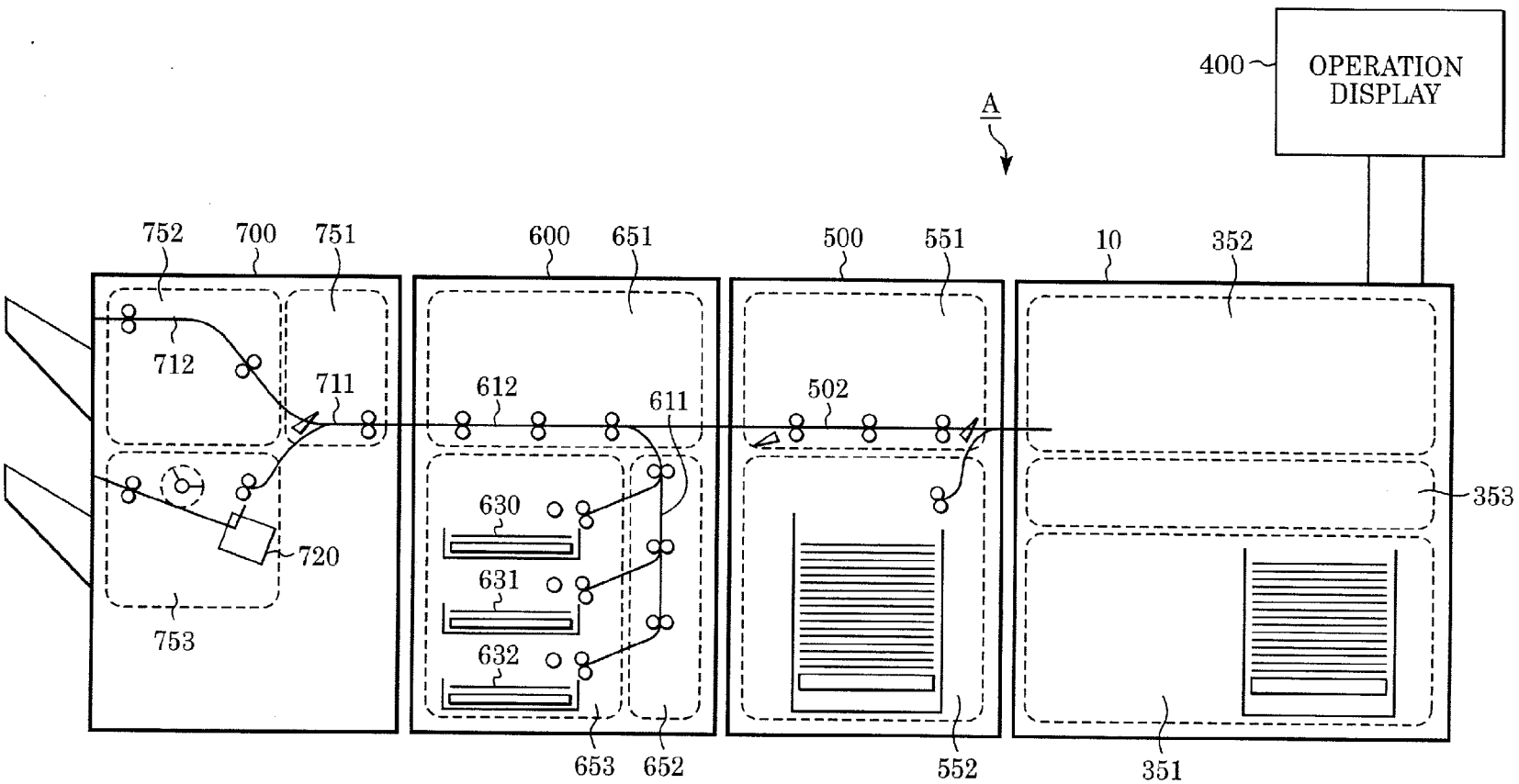
FIG. 3 is a schematic view of the sheet-processing system according to the embodiment, showing the arrangement of covers.

FIG. 3 is a schematic view of outer covers of the image formation device 10, the stacker 500, the inserter 600, and the finisher 700. The sheet-processing system of the present embodiment includes a covering component or cover that opens to expose the interiors of the sheet-processing devices, i.e., the image formation device 10, the stacker 500, the inserter 600, and the finisher 700. The printer 300 in the image formation device 10 includes a cover 351, a cover 352, and a cover 353. The cover 351 covers units related to the feeding of sheets. The cover 352 covers the photosensitive drum 111, the transferring unit 116, the fixing unit 117, a flapper 121, and transfer paths for guiding sheets to these units. The cover 353 covers the two-sided transfer path 124. The covers 351, 352, and 353 can be separately opened and a cover-opening detection sensor (not shown) detects whether or not the covers 351, 352, and 353 are open. The covers 351, 352, and 353 are opened when maintaining the printer 300, such as removing a paper jam, changing parts, cleaning parts, adjusting parts, or supplying paper.

The stacker 500 includes a cover 551 for covering the horizontal transfer path 502 and a cover 552 for covering the stacking unit 530. The covers 551 and 552 can be separately opened. Cover-opening detection sensors S54 and S55 detect whether or not the covers 551 and 552 are open. The covers 551 and 552 are opened when maintaining the stacker 500, such as removing a paper jam, changing parts, cleaning parts, adjusting parts, or taking out paper.

The inserter 600 includes a cover 651 for covering the horizontal transfer path 612, a cover 652 for covering the vertical transfer path 611, and a cover 653 for covering the sheet-accommodating units 630, 631, and 632, and the sheet-separating units 636, 637, and 638. The covers 651, 652, and 653 can be separately opened. Cover-opening detection sensors S64, S65, and S66 detect whether or not the covers 651, 652, and 653 are open. The covers 651 and 652 are opened when maintaining the inserter 600, such as removing a paper jam, changing parts, cleaning parts, adjusting parts, or supplying paper.

The finisher 700 includes a cover 751 for covering the finisher path 711, a cover 752 for covering the non-sort path 712, and a cover 753 for covering the stapling section including the stapler 720. The covers 751, 752, and 753 can be separately opened. The cover-opening detection sensors S74, S75, and S76 detect whether or not the covers 751, 752, and 753 are open. The covers 751, 752, and 753 are opened when maintaining the finisher 700, such as removing a paper jam, changing parts, cleaning parts, adjusting parts, or supplying paper.

[Structure of Controllers]

Figure 4:
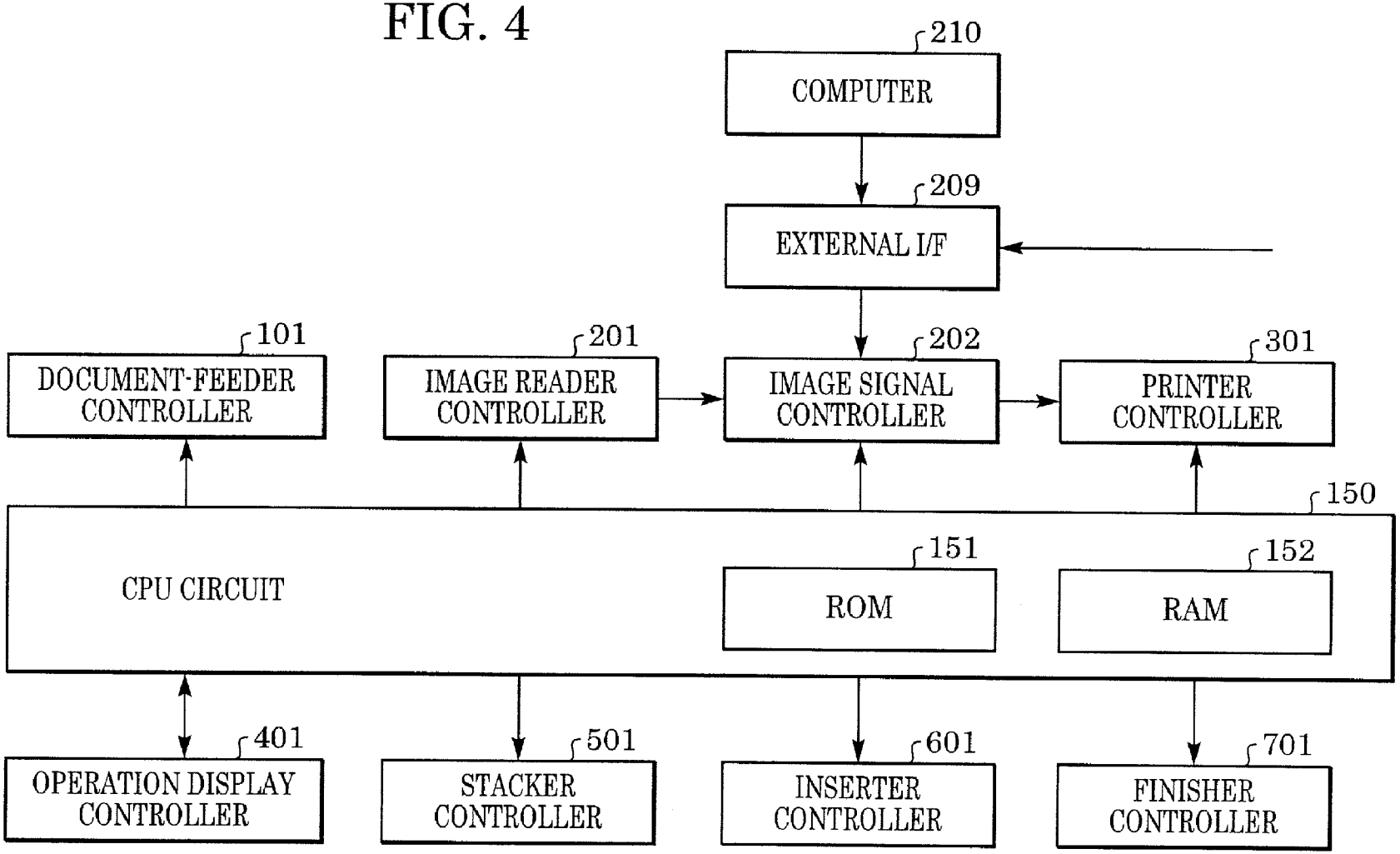
FIG. 4 is a block diagram of controllers for controlling the sheet-processing system according to the embodiment.

FIG. 4 is a block diagram showing the general structure of controllers of the sheet-processing system according to the present embodiment. Referring to FIG. 4, the controller includes a CPU circuit 150 having a CPU (not shown), a ROM 151 and a RAM 152.

The CPU circuit 150 controls a document-feeder controller 101, an image reader controller 201, an image signal controller 202, an external interface or external I/F 209, a printer controller 301, an operation display controller 401, a stacker controller 501, an inserter controller 601, and a finisher controller 701 via a control program stored in the ROM 151.

The RAM 152 stored in the CPU circuit 150 temporarily stores data for controlling the controllers, and computation necessary for controlling the controllers is also performed in the RAM 152. The document-feeder controller 101 controls the document feeder 100 in accordance with an instruction from the CPU circuit 150.

The image reader controller 201 controls the scanner unit 104, the image sensor 109 and the like and transfers an analog image signal output from the image sensor 109 to the image signal controller 202.

In accordance with an instruction from the CPU circuit 150, the image signal controller 202 converts the analog image signal from the image sensor 109 to a digital signal and applies several processes on the digital signal. The digital signal is then converted into a video signal and the video signal is output to the printer controller 301. The image signal controller 202 also performs several processes on a digital image signal which is input to the image signal controller 202 from a computer 210 via the external interface 209. Then, the image signal controller 202 converts the digital image signal to a video signal. This video signal is output to the printer controller 301.

The printer controller 301 controls the exposure controller 110 in accordance with the video signal input from the image signal controller 202. The operation display controller 401 controls exchange of information between the operation display 400 in the image formation device 10 and the CPU circuit 150. The operation display 400 is a touch panel display with one display frame and displays a display screen (job display screen) showing keys for setting various functions for image formation and settings of the sheet-processing devices. A key signal in accordance with the key selected in the operation display 400 is output to the CPU circuit 150 through the operation display controller 401. The operation display controller 401 controls the operation display 400 so that the operation display 400 displays information in accordance with a signal from the CPU circuit 150.

The stacker controller 501 is disposed in the stacker 500 and controls the stacker 500 via the CPU circuit 150. The inserter controller 601 is disposed in the inserter 600 and controls the inserter 600 via the CPU circuit 150. The finisher controller 701 is disposed in the finisher 700 and controls the finisher 700 via the CPU circuit 150.

[Structure of Stacker Controller]

Figure 5:
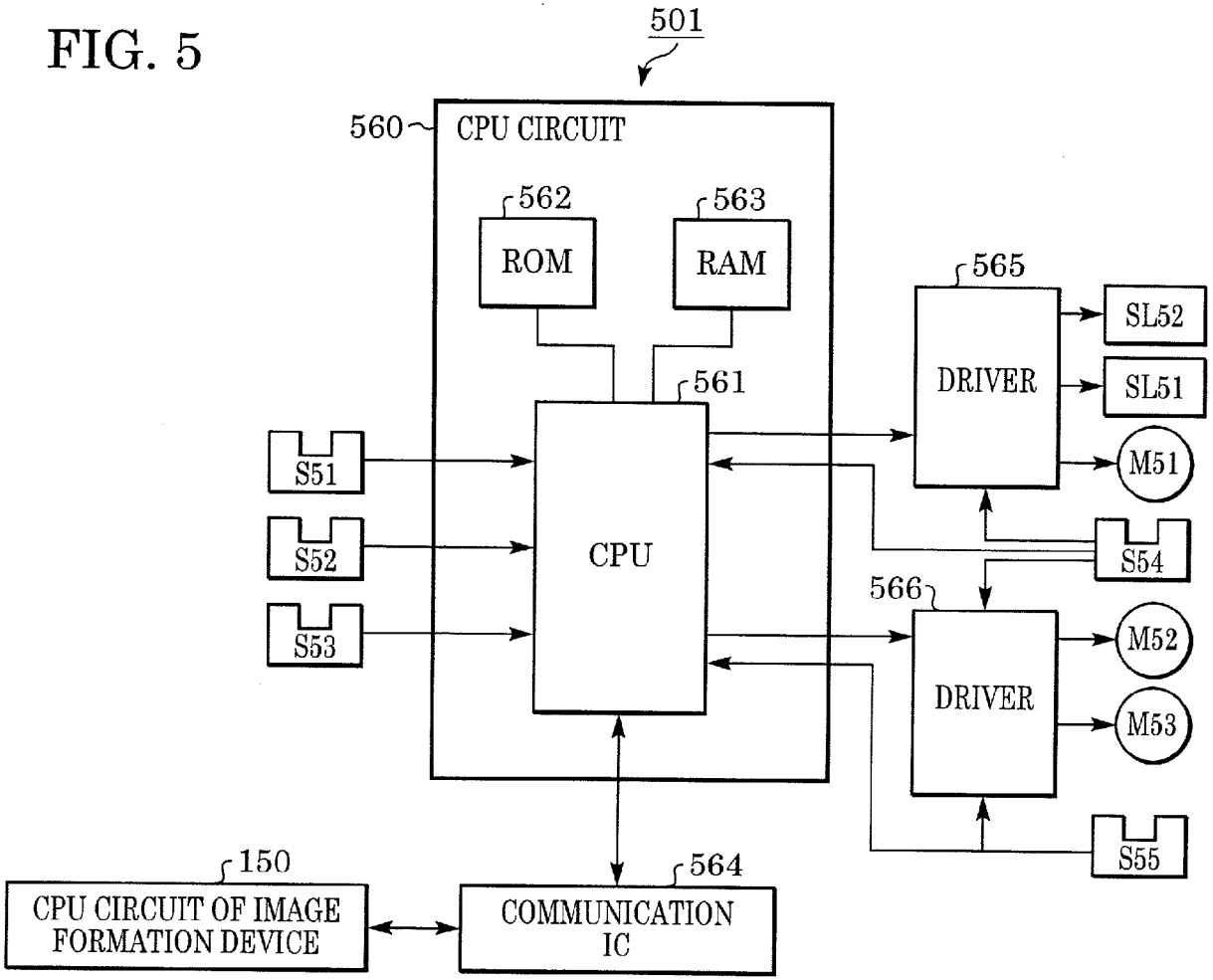
FIG. 5 is a block diagram of a stacker controller for controlling a stacker according to the embodiment.

FIG. 5 is a block diagram showing the structure of the stacker controller 501 for controlling the stacker 500. Referring to FIG. 5, the stacker controller 501 includes a CPU circuit 560 having a CPU 561, a ROM 562, a RAM 563 and the like. The CPU circuit 560 exchanges data with the CPU circuit 150 disposed at the image formation device 10 via a communication IC 564. The CPU circuit 560 executes various programs stored in the ROM 562 in accordance with an instruction from the CPU circuit 150 so as to control the stacker 500. Detection signals from path sensors S51, S52, and S53, which detect a delay or a jam of sheets being transferred, and detection signals from the cover-opening sensors S54 and S55 are input to the CPU circuit 560.

Drivers 565 and 566 are connected to the CPU circuit 560. The driver 565 drives a horizontal path transfer motor M51 and solenoids SL51 and SL52, which constitute a module for a first transferring process, in accordance with a signal from the CPU circuit 560. The driver 566 drives a stacking plate motor M52 and a stacked-sheets transfer motor M53, which constitute a modules for a sheet-stacking process, in accordance with a signal from the CPU circuit 560.

The module for the first transferring process is composed of the transfer rollers 503, 504, and 505 disposed in the stacker 500, the horizontal path transfer motor M51 for driving the transfer rollers 503, 504, and 505, the solenoid SL51 for switching the first flapper 510, and the solenoid SL52 for switching the second flapper 506. The module for the sheet-stacking process is composed of the stacking plate motor M52 for driving the stacking plate 521 in the stacking unit 530 and the stacked-sheets transfer motor M53 for driving transfer rollers 527 disposed on the transfer path 520.

When the cover-opening detection sensor S54 detects that the cover 551 is open, in response to the detection signal from the cover-opening detection sensor S54, a power source of the driver 565 is turned off and thus the module for the first transferring process is inactivated. Simultaneously, a power source of the driver 566 is turned off and thus the module for the sheet-stacking process is inactivated.

When the cover-opening detection sensor S55 detects that the cover 552 is open, in response to the detection signal from the cover-opening detection sensor S55, a power source of the driver 566 is turned off and thus the module for the sheet-stacking process is inactivated.

[Structure of Inserter Controller]

Figure 6:
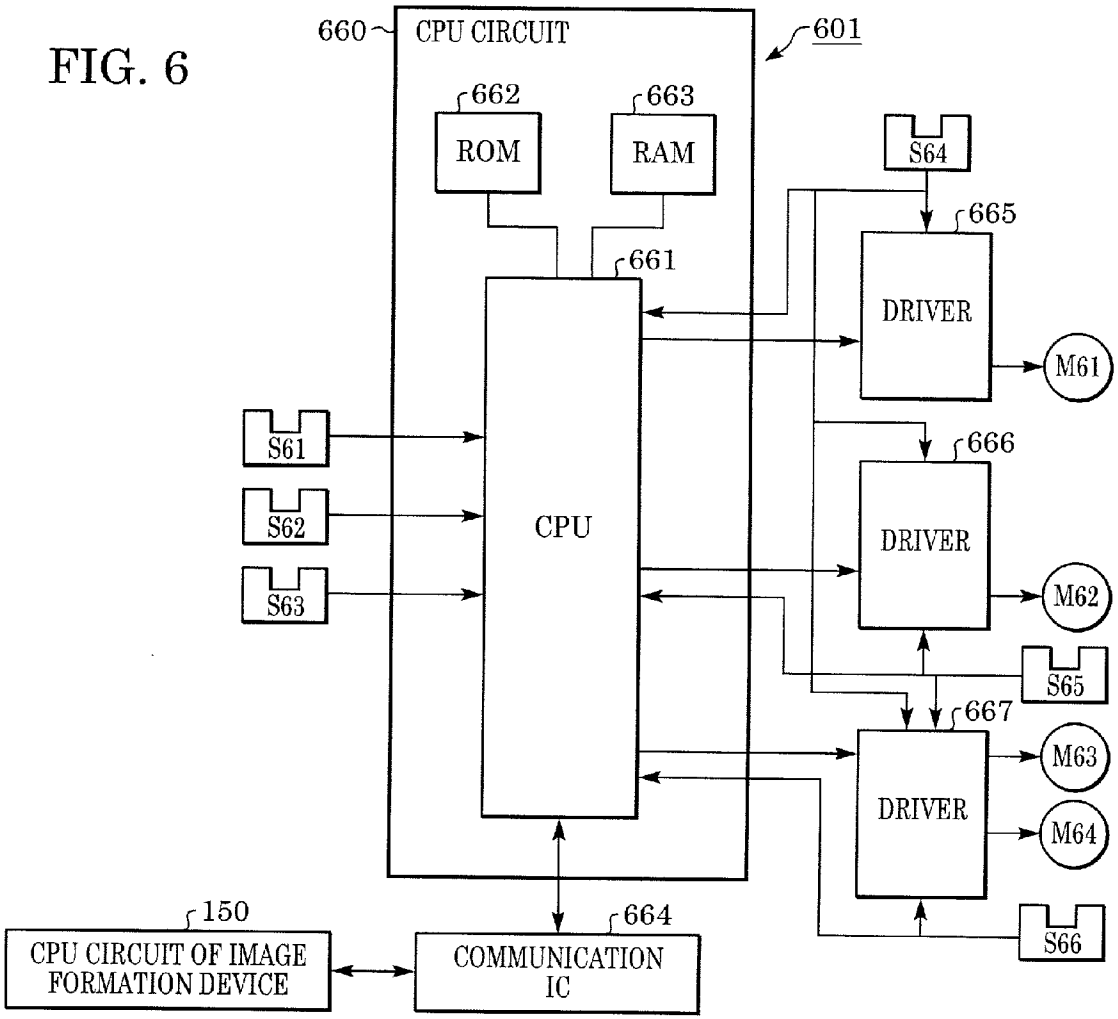
FIG. 6 is a block diagram of an inserter controller for controlling an inserter according to the embodiment.

FIG. 6 is a block diagram of the structure showing the inserter controller 601 for controlling the inserter 600. Referring to FIG. 6, the inserter controller 601 includes a CPU circuit 660 having a CPU 661, a ROM 662, a RAM 663 and the like. The CPU circuit 660 exchanges data with the CPU circuit 150 disposed at the image formation device 10 via a communication IC 664. The CPU circuit 660 executes various programs stored in the ROM 662 in accordance with an instruction from the CPU circuit 150 so as to control the inserter 600. Detection signals from path sensors S61, S62, and S63 and detection signals from the cover-opening sensors S64, S65, and S66 are input to the CPU circuit 660.

Drivers 665, 666 and 667 are connected to the CPU circuit 660. The driver 665 drives a horizontal path transfer motor M61, which constitutes a module for a horizontal-transferring process, in accordance with a signal from the CPU circuit 660. The driver 666 drives a vertical path transfer motor M62, which constitutes a module for a vertical-transferring process, in accordance with a signal from the CPU circuit 660. The driver 667 drives a sheet separation-motor M63 and an inner-plate motor M64, which constitute a module for a sheet-supplying process, in accordance with a signal from the CPU circuit 660.

The module for the horizontal-transferring process is composed of the transfer rollers 602, 603, and 604 and the horizontal path transfer motor M61 for driving the transfer rollers 602, 603, and 604. The module for the vertical-transferring process is composed of the transfer rollers 640, 641, and 642 and the vertical path transfer motor M62 for driving the transfer rollers 640, 641, and 642. The module for the sheet-supplying process is composed of the sheet-separating units 636, 637, and 638, the sheet-separation motor M63 for driving the sheet-separating units 636, 637, and 638, the inner plates 633, 634, and 635, and the inner-plate motor M64 for driving the inner plates 633, 634, and 635 up and down.

When the cover-opening sensor S64 detects that the cover 651 is open, a power source for the driver 665 is turned off in response to the detection signal from the cover-opening detection sensor S64 and thus the module for the horizontal-transferring process is inactivated. Simultaneously, power sources for the drivers 666 and 667 are turned off and thus the entire inserter 600 is inactivated.

When the cover-opening detection sensor S65 detects that the cover 652 is open, a power source for the driver 666 is turned off in response to the detection signal from the cover-opening detection sensor S65 and thus the module for the vertical-transferring process is inactivated. Simultaneously, a power source for the driver 667 is turned off and thus the module for the sheet-supplying process is inactivated. When the cover-opening detection sensor S66 detects that the cover 653 is open, a power source for the driver 667 is turned off in response to the detection signal from the cover-opening detection sensor S66 and thus the module for the sheet-supplying process is inactivated.

[Structure of Finisher Controller]

Figure 7:
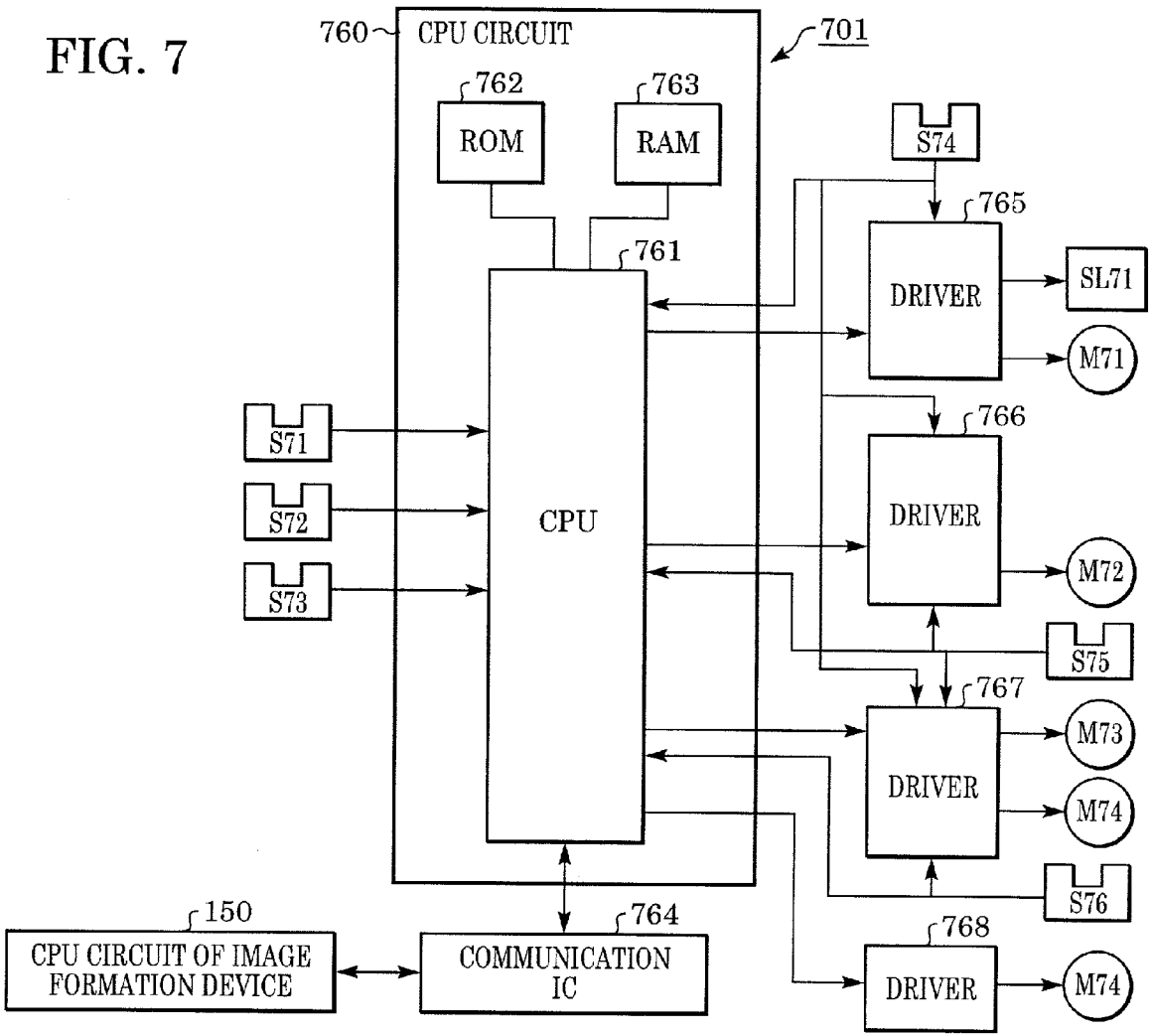
FIG. 7 is a block diagram of a finisher controller for controlling a finisher according to the embodiment.

FIG. 7 is a block diagram showing the structure of the finisher controller 701 for controlling the finisher 700. Referring to FIG. 7, the finisher controller 701 includes a CPU circuit 760 having a CPU 761, a ROM 762, a RAM 763, and the like. The CPU circuit 760 exchanges data with the CPU circuit 150 disposed at the image formation device 10 via a communication IC 764. The CPU circuit 760 executes various programs stored in the ROM 762 in accordance with an instruction from the CPU circuit 150 so as to control the finisher 700. Detection signals from path sensors S71, S72, and S73 and detection signals from the cover-opening sensors S74, S75, and S76 are input to the CPU circuit 760.

Drivers 765, 766, 767, and 768 are connected to the CPU circuit 760. The driver 765 drives a transfer motor M71 and a solenoid SL71 in response to a signal from the CPU circuit 760. The driver 766 drives a non-sort eject motor M72, which constitutes a module for a non-sort ejecting process, in response to a signal from the CPU circuit 760. The driver 767 drives a sort eject motor M75 and a bundle-transferring motor M73, which constitute a module for a sort ejecting process, in response to a signal from the CPU circuit 760. The driver 768 drives a tray motor M74, which constitutes a module for a tray-stacking process, in response to a signal from the CPU circuit 760.

The module for the second transferring process is composed of the entrance rollers 702, the transfer motor M71 for driving the entrance rollers 702, and the solenoid SL71 for switching the flapper 710. The module for the non-sort ejecting process is composed of the transfer rollers 706, the non-sort eject rollers 703, and the non-sort eject motor M72 for driving the transfer rollers 706 and the non-sort eject rollers 703. The module for the sort ejecting process is composed of the sort eject rollers 704, the sort eject motor M75 for driving the sort eject rollers 704, the eject rollers 705, and the bundle-transfer motor M73 for driving the eject rollers 705. The module for the tray-stacking process is composed of the stack tray 722 and the tray motor M74 for driving the stack tray 722.

The transfer motor M71, the non-sort eject motor M72, and the sort eject motor M75 are stepping motors. By controlling an excitation pulse rate, the rollers can be rotated at a constant speed or each roller can be separately rotated. The bundle-transfer motor M73 is a DC motor.

When the cover-opening detection sensor S74 detects that the cover 751 is open, a power source of the driver 765 is turned off in response to a detection signal from the cover-opening detection sensor S74 and thus the module for the second transferring process is inactivated. Simultaneously, power sources of the drivers 766, 767, and 768 are turned off and thus the entire finisher 700 is inactivated.

When the cover-opening detection sensor S75 detects that the cover 752 is open, a power source for the driver 766 is turned off in response to the detection signal from the cover-opening detection sensor S75 and thus only the module for the non-sort ejecting process is inactivated. When the cover-opening detection sensor S76 detects that the cover 753 is open, a power source for the driver 767 is turned off in response to the detection signal from the cover-opening detection sensor S76 and thus only the module for the sort ejecting process is selectively inactivated.

[Operation of Sheet-Processing System]

The operation of the sheet-processing system according to the present embodiment will now be described. The sheet-processing system of the present embodiment can perform a plurality of jobs in parallel by arbitrarily combining the image formation device 10, which reads documents and forms images onto sheets, and devices that perform various post-processes on the sheets output from the printer 300 in the image formation device 10, the devices including the stacker 500, the inserter 600, and the finisher 700. A job is a unit for sheet processing.

Figure 8:
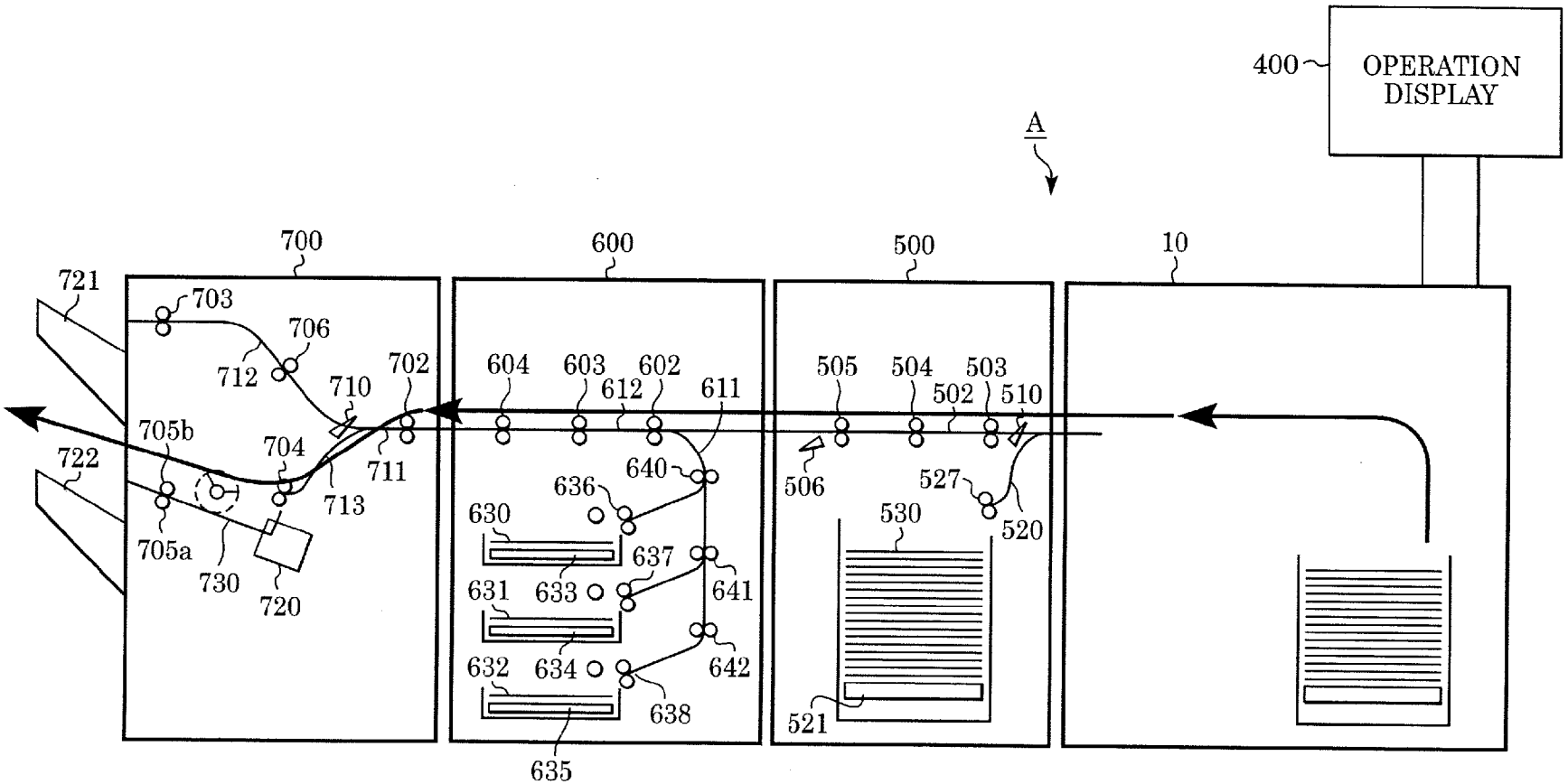
FIG. 8 is a schematic view of the sheet-processing system according to the embodiment, for describing the operation of the sheet-processing system.

FIG. 8 is a schematic view of the sheet-processing system A for describing a first job. The first job is a binding job where images of the documents are formed on sheets at the printer 300 and the sheets are aligned and stapled at the finisher 700, thereby outputting the bound sheets. The first job is performed by combining the image formation device 10, the stacker 500, the inserter 600, and the finisher 700.

In the first job, in response to an instruction from the CPU circuit 150 in the image formation device 10, the CPU 561 in the stacker 500 causes the first flapper 510 to be switched such that sheets are prevented from entering the transfer path 520 by the solenoid SL51 and, simultaneously, the horizontal path transfer motor M51, which constitutes the module for the horizontal-transferring process, is activated so as to drive the transfer rollers 503, 504, and 505. In response to an instruction from the CPU circuit 150, the CPU 661 in the inserter 600 causes the horizontal path transfer motor M61, which is the module for the horizontal-transferring process, to drive the transfer rollers 602, 603, and 604 on the horizontal transfer path 612. In response to an instruction from the CPU circuit 150, the CPU 761 in the finisher 700 causes the flapper 710 to be switched such that the sheets are prevented from entering the non-sort path 712 by the solenoid SL71 and, simultaneously, the transfer motor M71, the sort eject motor M75, the bundle-transfer motor M73, and the tray motor M74, which constitute the module for the second transferring process, are activated so as to drive the entrance rollers 702, the sort eject rollers 704, the eject rollers 705, and the stack tray 722.

By controlling the sheet-processing system A as described above, passing along the horizontal transfer path 502 in the stacker 500 and the horizontal transfer path 612 in the inserter 600, the sheets with images formed at the printer 300 are transferred onto the intermediate tray 730 in the finisher 700. The stacked sheets in bundles on the intermediate tray 730 are aligned and stapled by the stapler 720 and then ejected onto the stack tray 722. Alternatively, the stapler 720 may also perform punching or the like.

Figure 9:
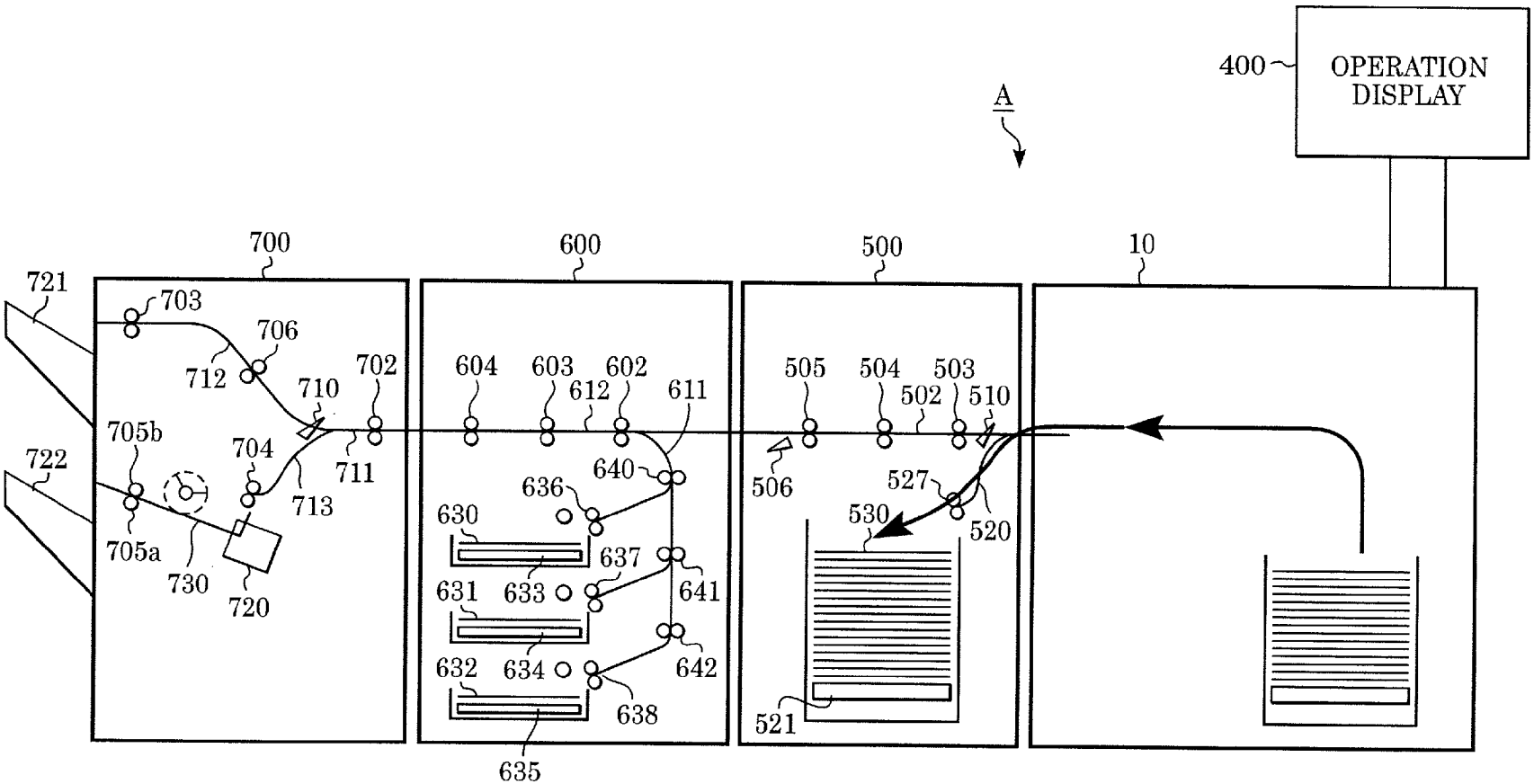
FIG. 9 is a schematic view of the sheet-processing system according to the embodiment, for describing the operation of the sheet-processing system.

FIG. 9 is a schematic view of the sheet-processing system A for describing a second job. The second job is a stacking job by the image formation device 10 and the stacker 500. The images of documents are formed at the printer 300 in the image formation device 10 and, thereafter, the sheets are stacked in the stacker 500. In this second job, the sheets output from the image formation device 10 are temporarily stacked in the stacker 500. The sheets are stacked in the stacker 500 so that the difference in processing ability among the image formation device 10, the inserter 600, and the finisher 700 are adjusted.

In the second job, in response to an instruction from the CPU circuit 150 in the image formation device 10, the CPU 561 in the stacker 500 causes the first flapper 510 to be switched such that the sheets are prevented from entering the horizontal transfer path 502 by the solenoid SL51, and, simultaneously, the stacked-sheets transfer motor M53 and the stacking plate motor M52, which constitute the module for the sheet-stacking process, are activated so as to drive the transfer rollers 527 on the transfer path 520 and the stacking plate 521 in the stacking unit 530.

By controlling the sheet-processing system A as described above, the sheets with images formed at the printer 300 pass along the transfer path 520 to be stacked in the stacking unit 530. The stacking plate 521 descends corresponding to the amount of the stacked sheets.

Figure 10:
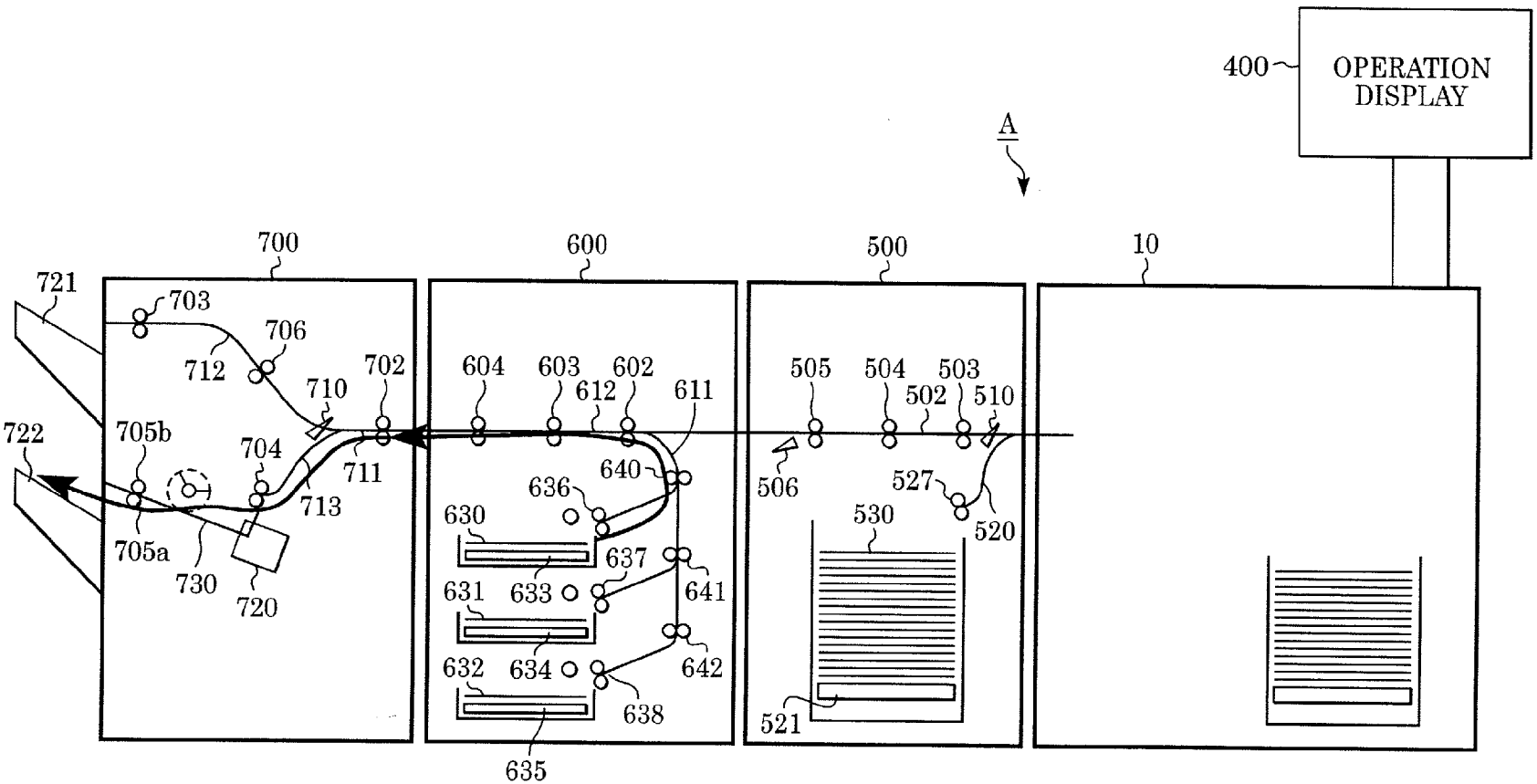
FIG. 10 is a schematic view of the sheet-processing system according to the embodiment, for describing the operation of the sheet-processing system.

FIG. 10 is a schematic view of the sheet-processing system A for describing a third job. The third job is performed by combining the inserter 600 and the finisher 700. More specifically, the third job is a binding job where special-purpose paper such as color copy paper stored in the inserter 600 are inserted into the sheets from the image formation device 10 and the special-purpose paper is bound and stapled with the sheets from the image formation device 10 in the finisher 700, thereby outputting the bound sheets.

In the third job, in response to an instruction from the CPU circuit 150 in the image formation device 10, the CPU 661 in the inserter 600 causes the sheet-separation motor M63 and the inner-plate motor M64, which constitute the module for the sheet-supplying module, to be activated so as to drive the sheet-separating units 636, 637, and 638 and the inner plates 633, 634, and 635. Moreover, in response to an instruction from the CPU circuit 150, the CPU 761 in the finisher 700 causes the flapper 710 to be switched such that the sheets are prevented from entering the non-sort path 712 by the solenoid SL71, and, simultaneously, the transfer motor M71, the sort eject motor M75, the bundle-transfer motor M73, and the tray motor M74, which constitute the module for the transferring process, are activated so as to drive the entrance rollers 702, the sort eject rollers 704, the eject rollers 705, and the stack tray 722.

By controlling the sheet-processing system A, the special-purpose paper supplied from the inserter 600 is transferred to and stacked on the intermediate tray 730 in the finisher 700. The special-purpose paper, which is bound with the sheets from the image formation device 10 and is stacked on the intermediate tray 730, is aligned and stapled with the stapler 720, thereby outputting the bound sheets onto the stack tray 722. Alternatively, the stapler 720 may also perform punching or the like.

Figure 11:
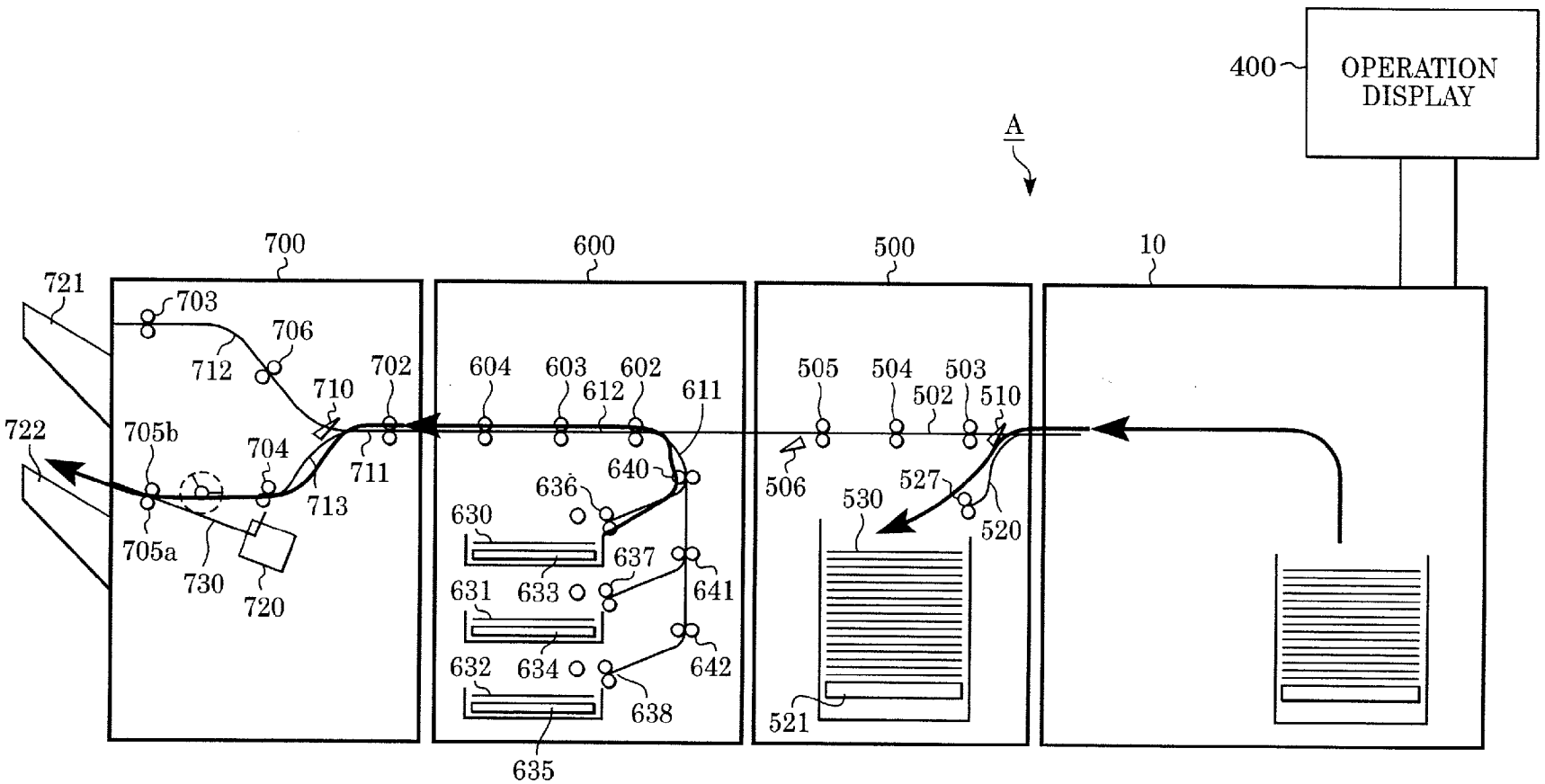
FIG. 11 is a schematic view of the sheet-processing system according to the embodiment, for describing the operation of the sheet-processing system.

FIG. 11 is a schematic view of the sheet-processing system A for describing a fourth job. The fourth job is an example where two jobs are simultaneously performed in the sheet-processing system A.

In the fourth job, one job (second job) is performed by combining two or more sheet-processing devices next to each other, and another job (third job) is performed by combining two or more sheet-processing devices next to each other that are different from the ones that perform the second job.

More specifically, the aforementioned second job and the third job are simultaneously performed. As described above, in the second job, images are formed on sheets at the image formation device 10 and the sheets are stacked in the stacker 500, and in the third job (binding job), the special-purpose paper stored in the inserter 600 is bound and stapled with the sheets from the image formation device 10 at the finisher 700, thereby outputting the bound sheets.

When performing the fourth job, the third job is performed by two or more sheet-processing devices next to each other that are different from the sheet-processing devices that perform the second job. The transfer path 520 and the transfer rollers 527 used in the second job are disconnected from the horizontal transfer path 612, the transfer rollers 602, 603, and 604, the finisher path 711, the sort path 713, the entrance rollers 702, the sort eject rollers 704, and the eject rollers 705 that are used in the third job.

Accordingly, since the sheet-processing devices for the second job are not activated, the sheet-processing devices for the first job can process the first job and vice versa. Thus, productivity of the sheet-processing system is improved.

In the fourth job, in response to an instruction from the CPU circuit 150 in the image formation device 10, the CPU 561 in the stacker 500 causes the second flapper 506 to be switched such that sheets are prevented from entering the inserter 600 by the solenoid SL52. Accordingly, even if a sheet is erroneously transferred to the horizontal transfer path 502, due to an operational failure of the first flapper 510, instead of being stacked in the stacker 500, the second flapper 506 prevents the sheet from entering the inserter 600. Accordingly, mixture of sheets from different jobs is prevented, thereby improving reliability of the binding job. Other operations of the fourth job are the same as those of the second and third jobs and thus description thereof is omitted here.

As has been described, two jobs can be simultaneously performed by arbitrarily combining the image formation device 10 and other devices, i.e., the stacker 500, the inserter 600 and the finisher 700. For example, while document reading or printing (image formation) is performed in the image formation device 10, the third job using the inserter 600 and the finisher 700 can be performed.

Moreover, the first job and the third job may be performed simultaneously. In this case, two jobs are simultaneously performed by sharing the horizontal transfer path 612 and the transfer rollers 602, 603, and 604 in the inserter 600 and all the units in the finisher 700. Alternatively, the third job may interrupt the first job. Furthermore, the horizontal transfer path 612 and the transfer rollers 602, 603, and 604 in the inserter 600 may be alternately used between the first job and the third job.

[Display Screen in Operation Display]

Display screens (job display screens) in the operation display 400 in the sheet-processing system according to the present embodiment will now be described with reference to FIGS. 12 to 36. The operation display 400 of the present embodiment includes input means such as input keys, a display frame of a touch panel display that shows, e.g., input settings, a numeric keypad, a start key, a reset key and the like. Display for the sheet processing will be described by referring to the shifting screens of the touch panel display and flow charts corresponding to the sheet processing.

Figure 12:
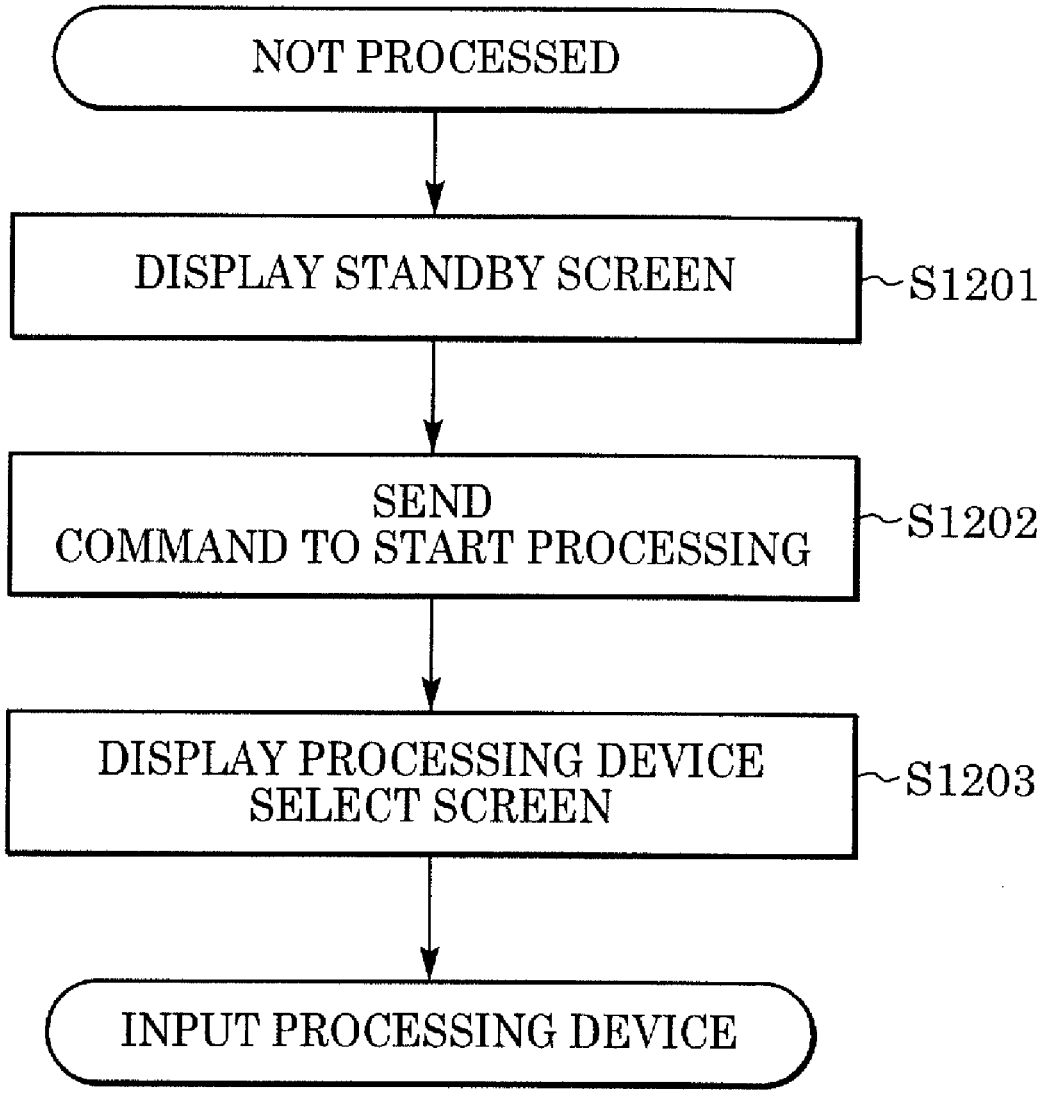
FIG. 12 is a flow chart of sheet processing in accordance with shifting screens in the sheet-processing system of the embodiment.
Figure 15:
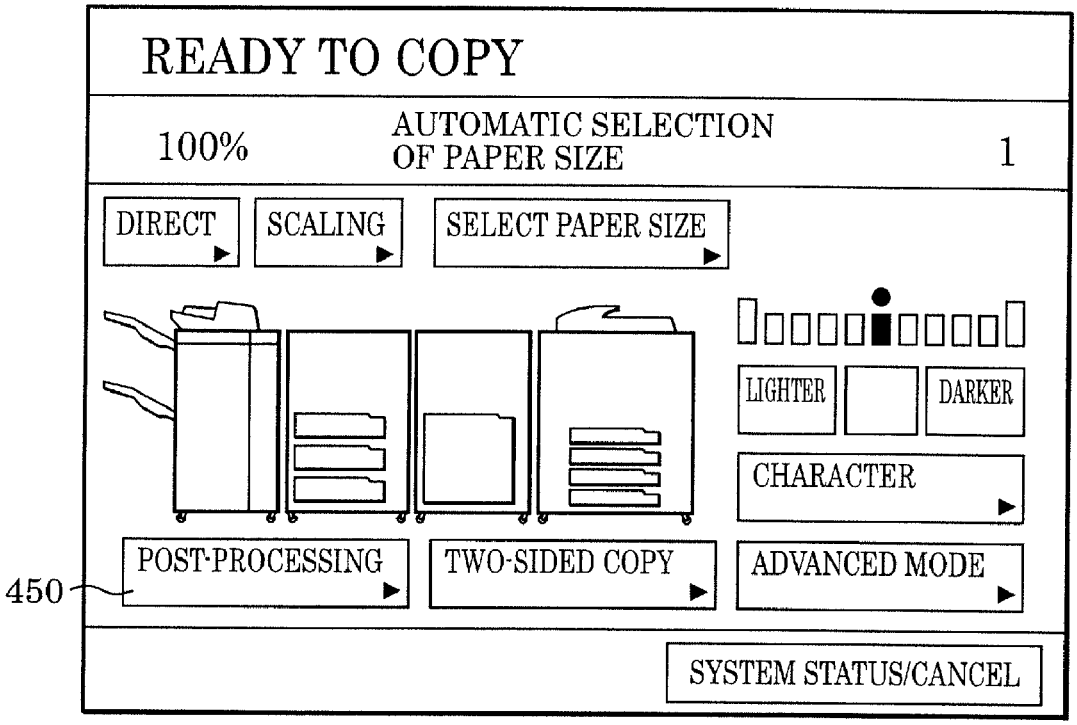
FIG. 15 shows a display screen in a display frame provided in the sheet-processing system according to the embodiment.

Referring to FIG. 12, when there is no job (not processed), a standby screen shown in FIG. 15 is displayed on the screen (S1201). FIG. 15 shows a screen when the system is on standby. In this state, the sheet-processing system A is not activated so that all the possible sheet processing can be selected in the sheet-processing system A.

During standby, a user selects one job, for example, presses a post-process button 450 shown in FIG. 15. When the post-process button 450 is selected, an instruction is transmitted to the CPU circuit 150 (S1202) and a processing-device select screen is displayed (S1203). On the standby screen shown in FIG. 15, the user also inputs image transfer conditions such as a magnification, density, image quality, sheet type, or post-process condition. When the post-process button 450 is pressed, the screen is changed to the processing-device select screen shown in FIG. 16. In this screen shown in FIG. 16, the user selects a device to perform sheet-processing.

Figure 16:
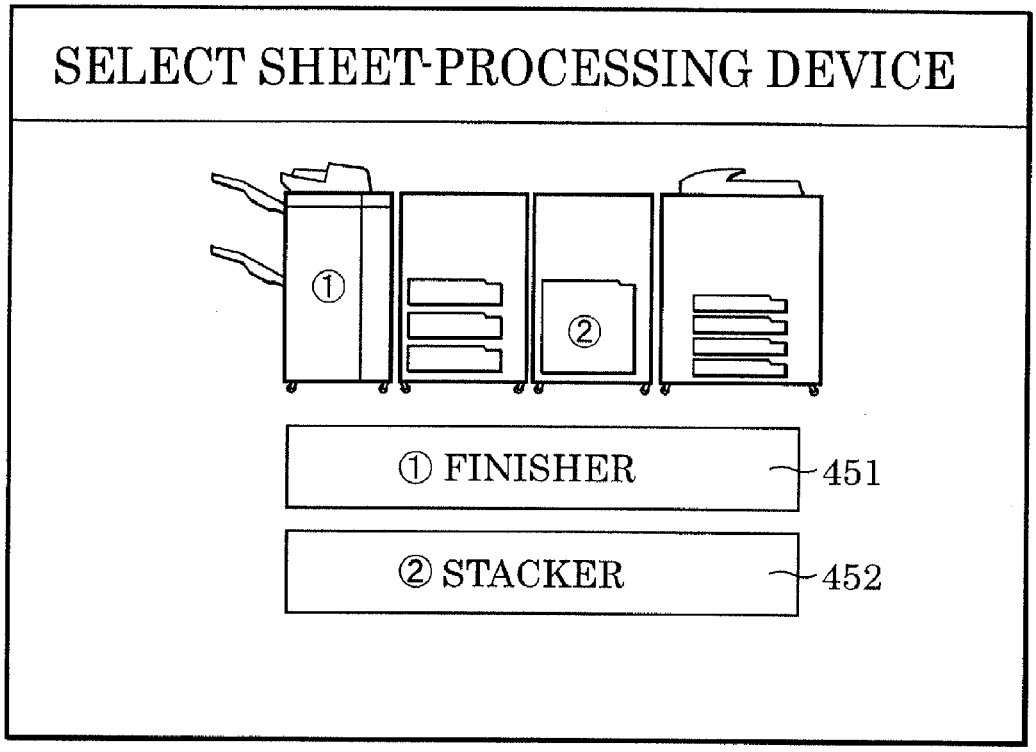
FIG. 16 shows a display screen in the display frame in the sheet-processing system according to the embodiment.
Figure 17:
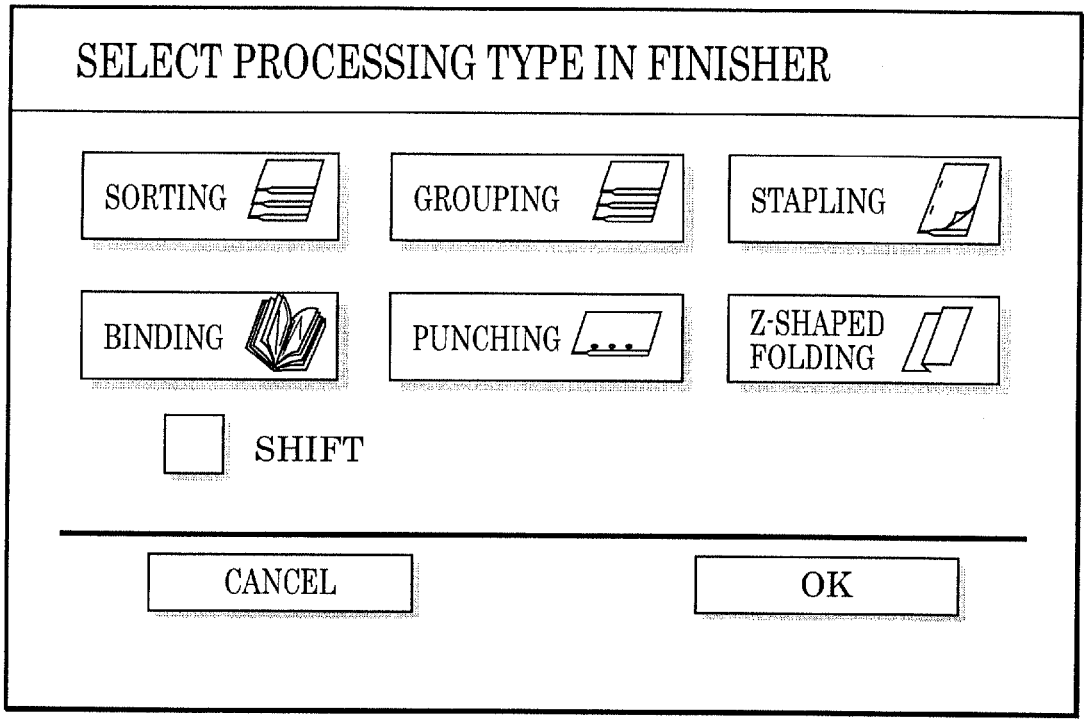
FIG. 17 shows a display screen in the display frame in the sheet-processing system according to the embodiment.

When the user selects a finisher select button 451 in the processing-device select screen shown in FIG. 16, the screen is changed to a processing-type input screen shown in FIG. 17. In this screen in FIG. 17, the user inputs a processing-type to be performed in the finisher 700. In this case, since the finisher 700 is located in the end of the system, parallel processing cannot be performed during this job. Therefore, a parallel-processing button will not appear on the display. The parallel-processing button is an example of a parallel-processing job execution key.

Figure 18:
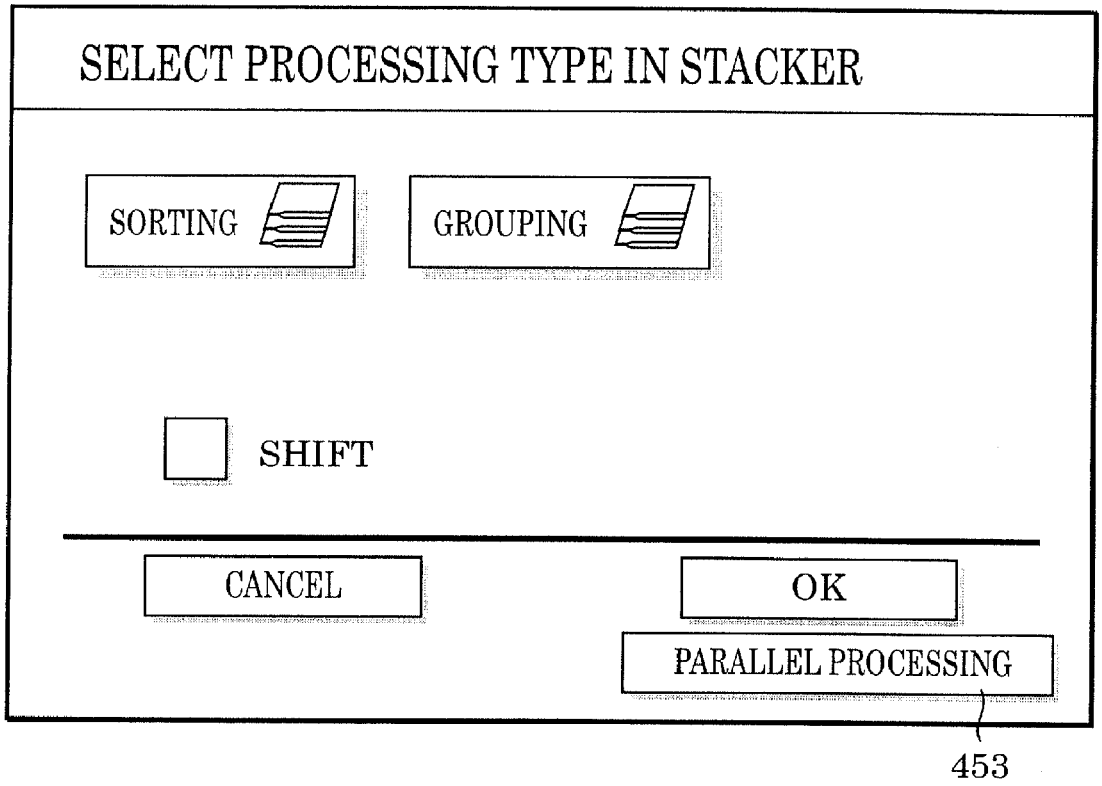
FIG. 18 shows a display screen in the display frame in the sheet-processing system according to the embodiment.

By contrast, when the user selects a stacker select button 452 on the processing-device select screen shown in FIG. 16, only the image formation device 10 and the stacker 500 will be used. Since the inserter 600 and the finisher 700 are downstream devices in the sheet-processing system A, these two devices can be used for another job, whereby a parallel-processing button or parallel-processing job execution key 453 appears at the corner of the touch panel display, as shown in FIG. 18. While a stacking job (second job) is performed by the stacker 500, the parallel-processing button 453 remains on the screen in order to accept parallel processing. The CPU circuit 150 determines whether or not another job can be performed in parallel with the job selected by the user, considering combinations of the sheet-processing devices in the sheet-processing system A. If the CPU circuit 150 determines that a parallel job can be performed, the parallel-processing button 453 appears on the screen.

Figure 13:
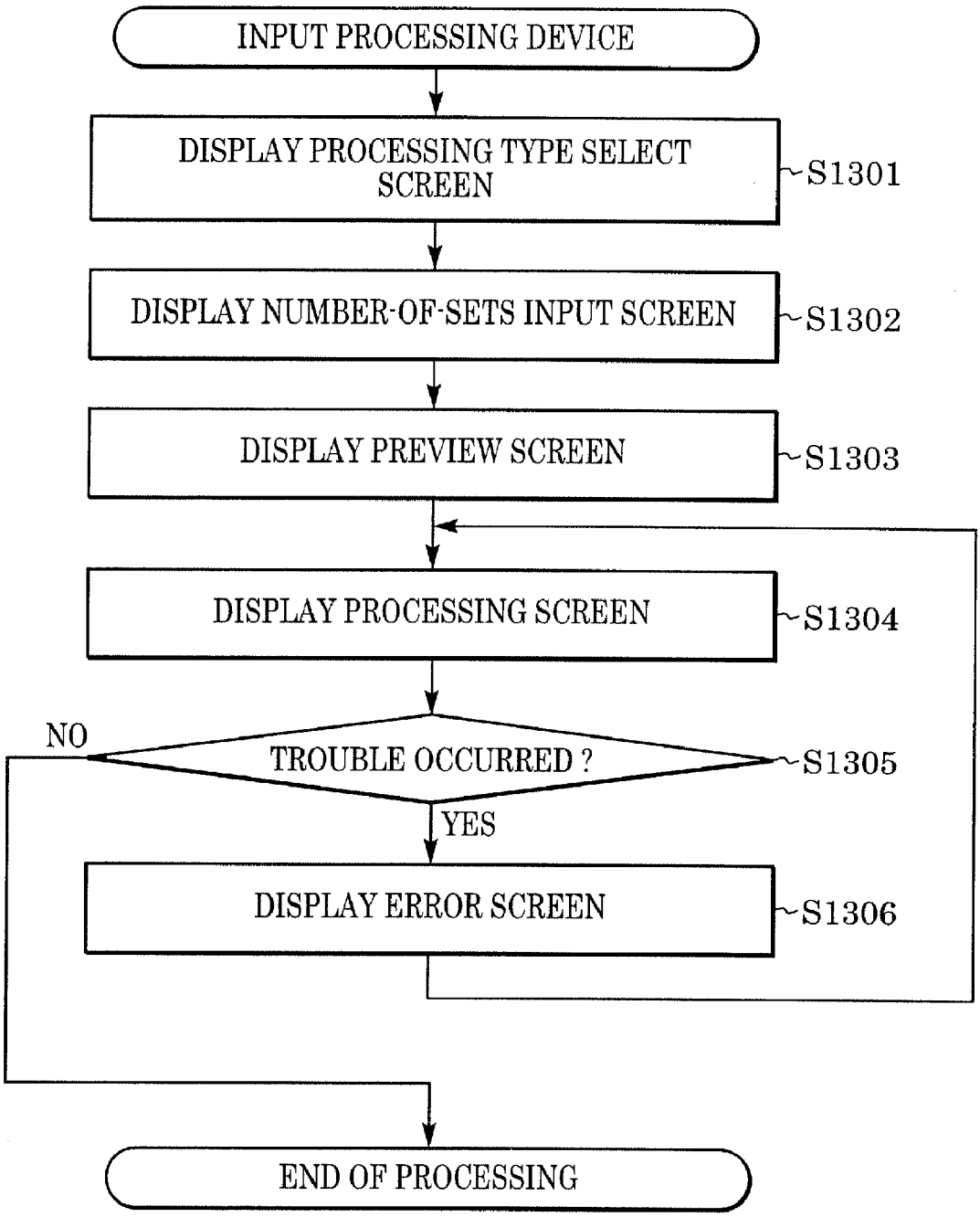
FIG. 13 is a flow chart of sheet processing in accordance with shifting screens in the sheet-processing system of the present embodiment.

Next, the flow of input operation regarding a general job following the flow chart in FIG. 12 will now be described in reference to FIG. 13. After selecting a device to perform sheet processing (Input processing device), a processing-type select screen to select a type of process in the selected processing device is displayed (S1301). The screens shown in FIG. 17 and FIG. 18 are examples of the processing-type select screen. After a processing type is selected in the processing-type select screen shown in FIG. 17, an OK button is pressed if the selected type is correct.

Figure 19:
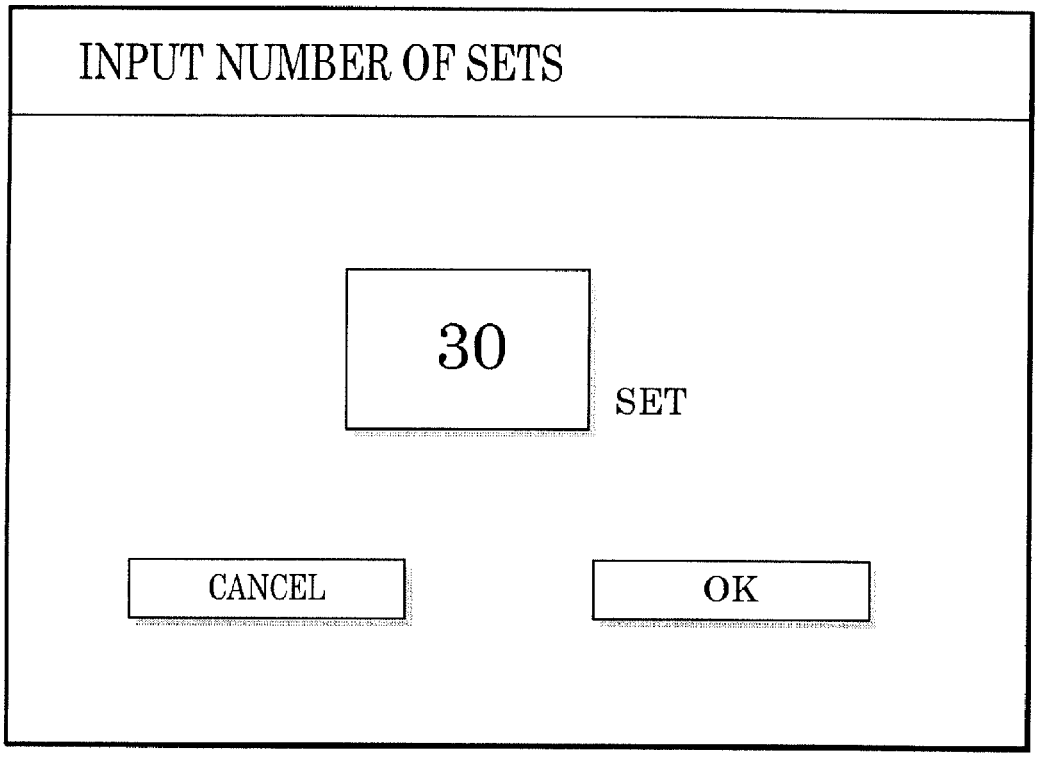
FIG. 19 shows a display screen in the display frame in the sheet-processing system according to the embodiment.

When the OK button is selected on the processing-type select screen, the screen is changed to a the-number-of-sets input screen shown in FIG. 19 (S1302). In the-number-of-sets input screen shown in FIG. 19, the number of bound copies to be processed is input with the numeric keypad disposed by the display and the OK button is pressed if the input number is correct.

Figure 20:
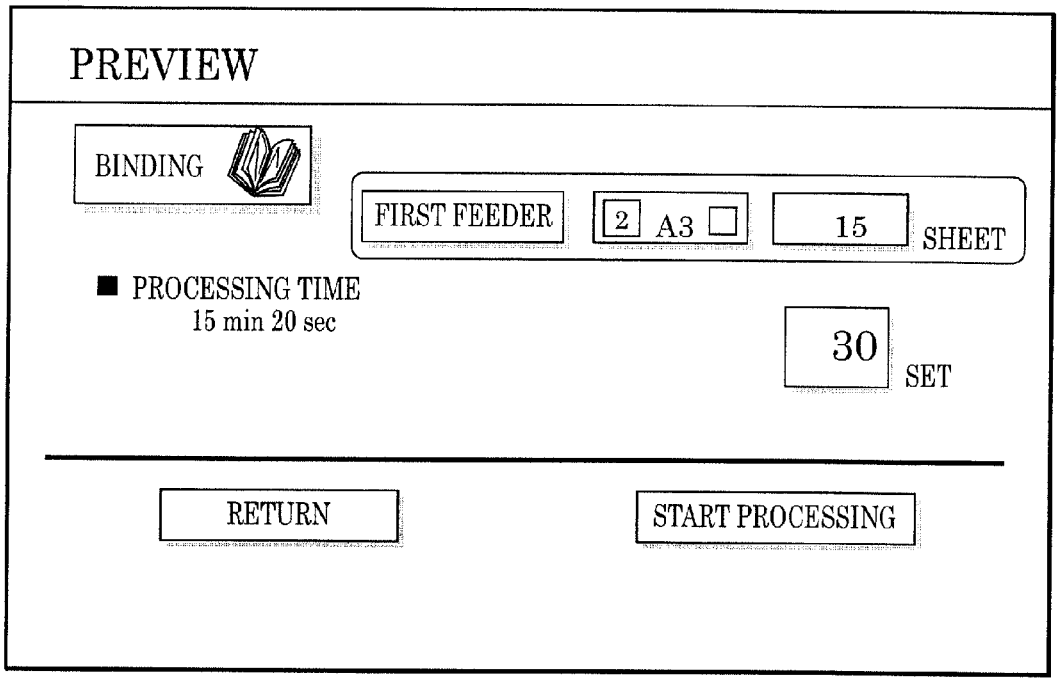
FIG. 20 shows a display screen in the display frame in the sheet-processing system according to the embodiment.

When the OK button is selected in the the-number-of-sets input screen shown in FIG. 19, the screen is changed to a preview screen shown in FIG. 20 to confirm the input settings (S1303). The user confirms the input settings in the preview screen. If the settings are correct, a start button is pressed or a start key (not shown) disposed outside the display is turned on.

Figure 21:
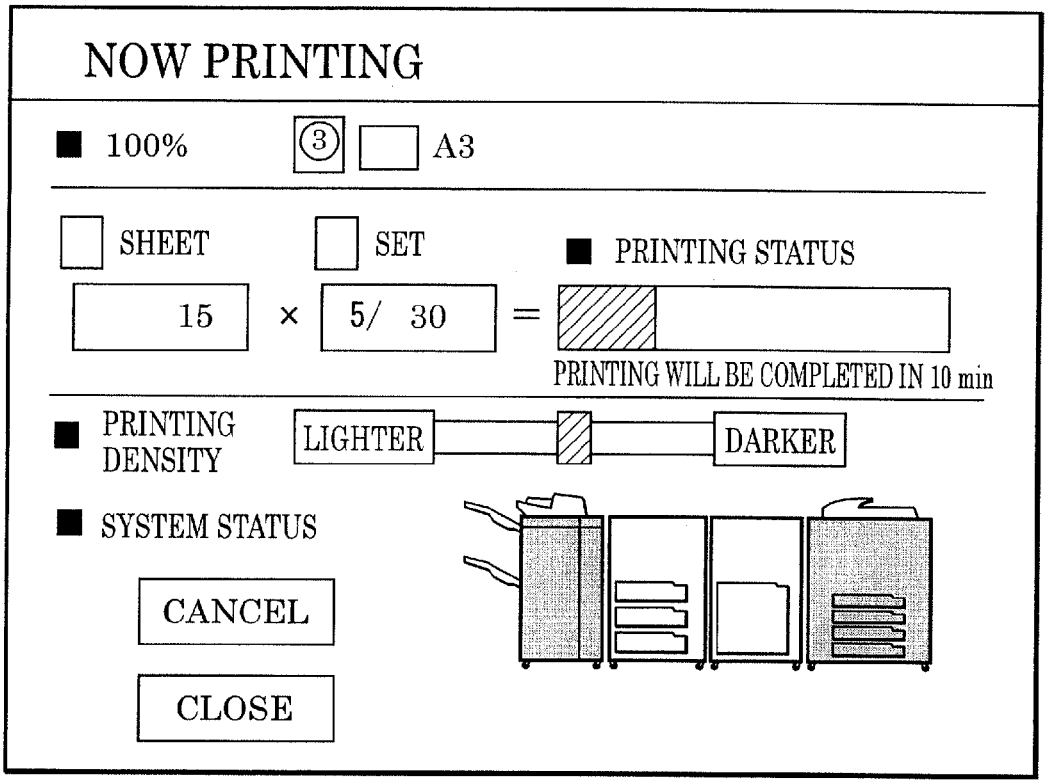
FIG. 21 shows a display screen in the display frame in the sheet-processing system according to the embodiment.
Figure 22:
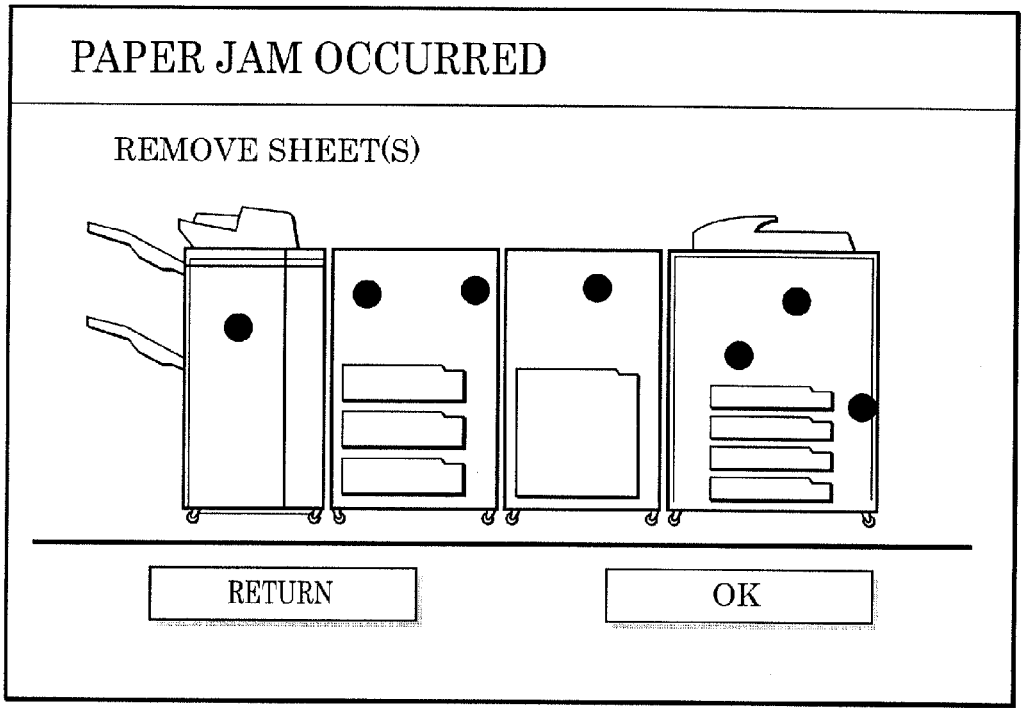
FIG. 22 shows a display screen in the display frame in the sheet-processing system according to the embodiment.

When the start button shown in FIG. 20 is pressed or the start key is turned on, a job according to the input settings is started. When the job is started, the screen is changed to a processing screen shown in FIG. 21 (S1304). The processing screen in FIG. 21 provides processing conditions, the number of sets to be processed, processing time, the status of the system processing the job.

The CPU circuit 150 monitors the system at all times to detect a problem such as a paper jam during a job (S1305). When a problem is detected, the job is halted and an error screen shown in FIG. 22 automatically appears. The error screen shows instructions for the user to address the problem (S1306). When the problem is solved, the screen returns to the processing screen shown in FIG. 21 and the system resumes the interrupted job. When the job is successfully completed, the screen returns to the standby screen shown in FIG. 15.

In the above-described case, the finisher select button 451 is selected on the processing-device select screen shown in FIG. 16. When a stacker select button 452 is selected on the screen, a job is processed in the same flow as in FIG. 13 along with the same screen change.

Figure 23:
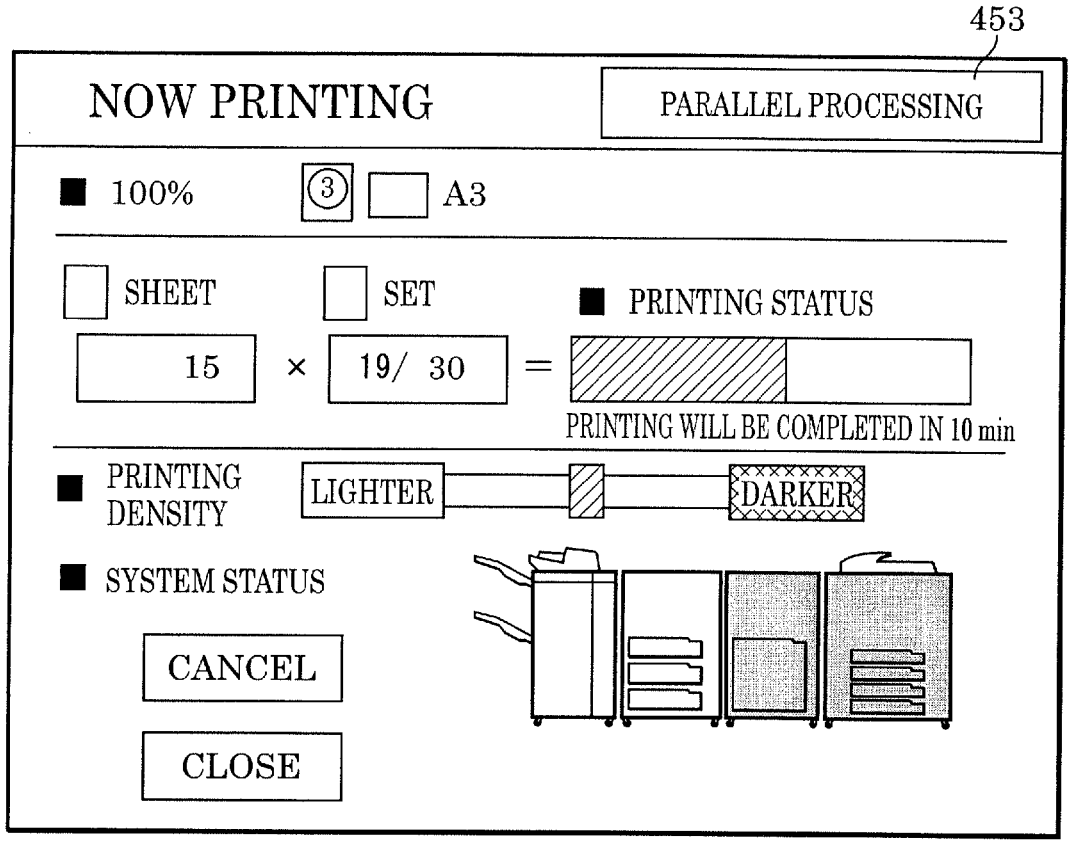
FIG. 23 shows a display screen in the display frame in the sheet-processing system according to the embodiment.

When the stacker select button 452 is selected, the parallel-processing button 453, which is typically shown in FIG. 18, appears on the screens at all times while the job is being processed. For example, when the aforementioned stacking job (second job) is performed by the stacker 500, a processing screen shown in FIG. 23 is displayed. The stacking job is called as the second job in the above description and will be referred to as process 1 hereinbelow. This processing screen provides the parallel-processing button 453, besides a process condition, the number of sets to be processed, processing time, and the status of the system processing the job.

Figure 24:
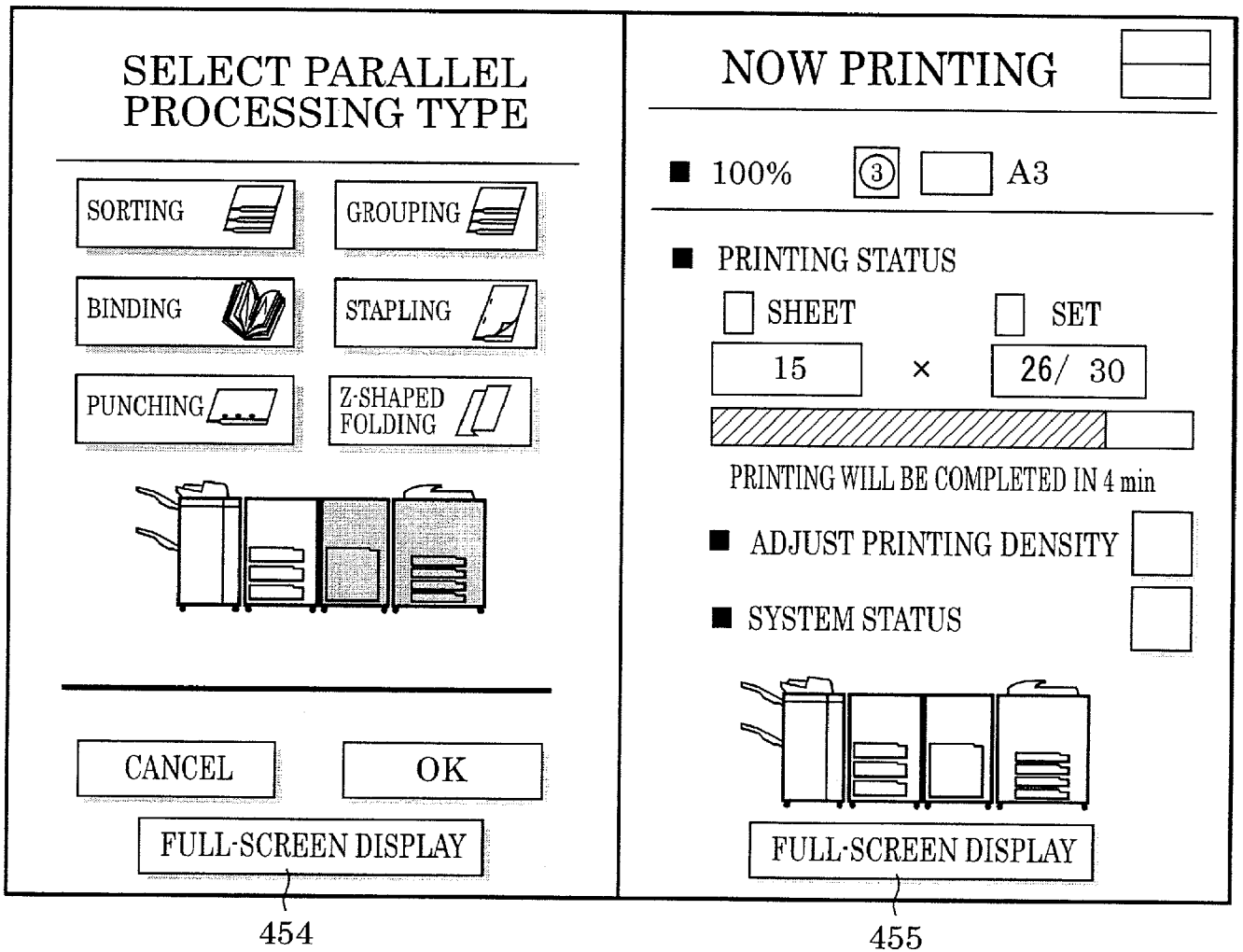
FIG. 24 shows a display screen in the display frame in the sheet-processing system according to the embodiment.

When the parallel-processing button 453 is pressed on the processing screen for process 1 shown in FIG. 23, another job such as the aforementioned fourth job is simultaneously performed. During process 1 shown in FIG. 23, another user presses the parallel-processing button 453 and the aforementioned binding job (third job) to be performed in the finisher 700 is selected. This binding job is called as the third job in the above description and will be referred to as process 2 hereinbelow. When the parallel-processing button 453 is pressed, the screen is divided into two within one display frame, and the segmented screens are designated to respective jobs as shown in FIG. 24. In this way, settings for each job can be input at the same time.

The initial segmented screens shown in FIG. 24 are displayed in accordance with the arrangement of the devices in the sheet-processing system A. That is, process 1 using the image formation device 10 and the stacker 500 is displayed on the right side of the display frame because the image formation device 10 and the stacker 500 are disposed on the right side in the sheet-processing system A. Process 2 using the inserter 600 and the finisher 700 is displayed on the left side of the display frame because the inserter 600 and the finisher 700 are disposed on the left side in the sheet-processing system A.

When a full-screen display button 454 is selected on the screen shown in FIG. 24, only the left segmented screen for process 2 will be displayed in the entire display frame. Similarly, when a full-screen display button 455 is pressed on the screen in FIG. 24, only the right segmented screen for process 2 will be displayed in the entire display frame. The full-screen display in FIG. 25 includes a segmented-screen select button 456 and selecting this button switches the full-screen display to the segmented display screens shown in FIG. 24.

Figure 14:
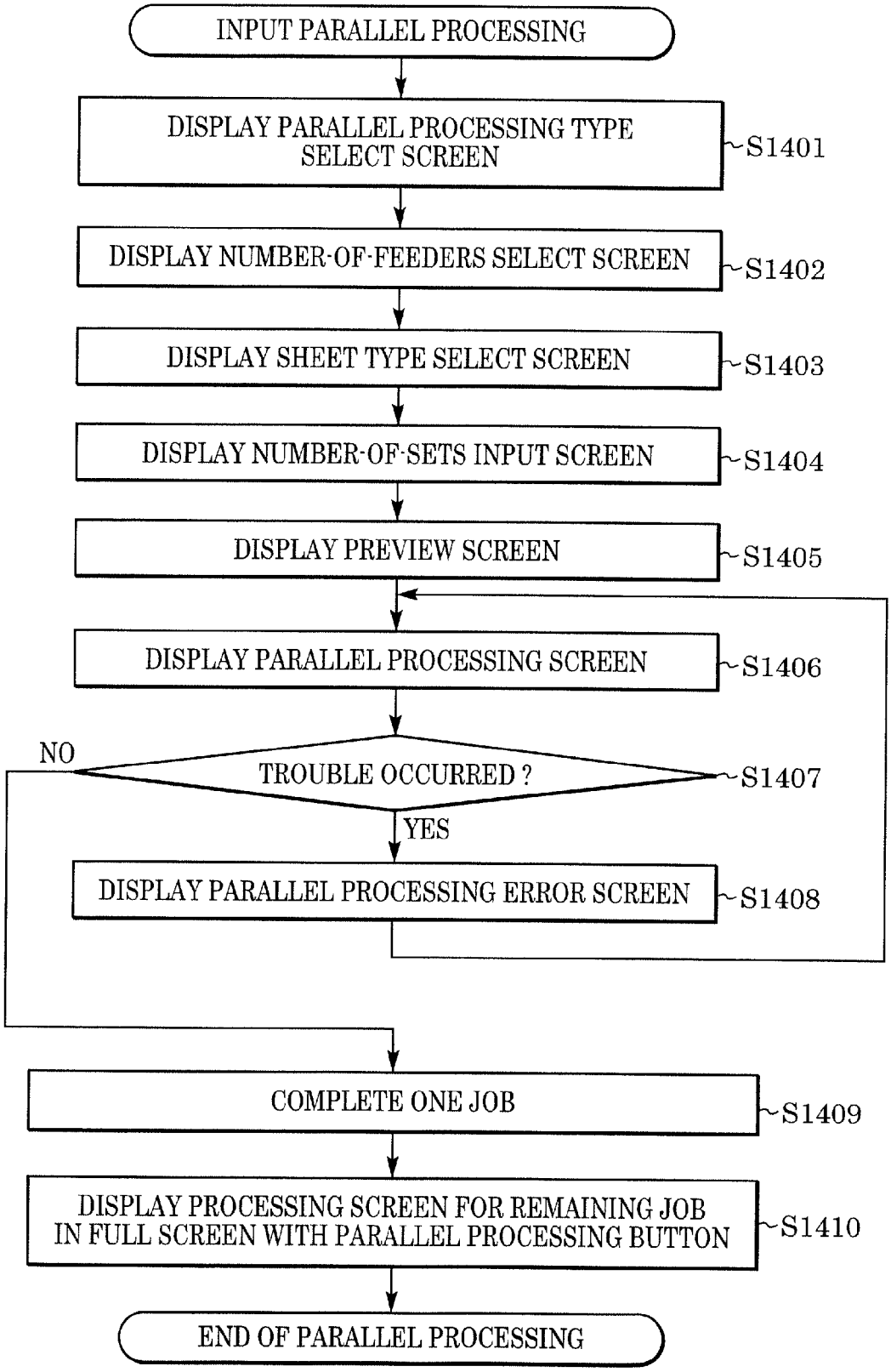
FIG. 14 is a flow chart of sheet processing in parallel in accordance with shifting screens in the sheet-processing system of the embodiment.
Figure 25:
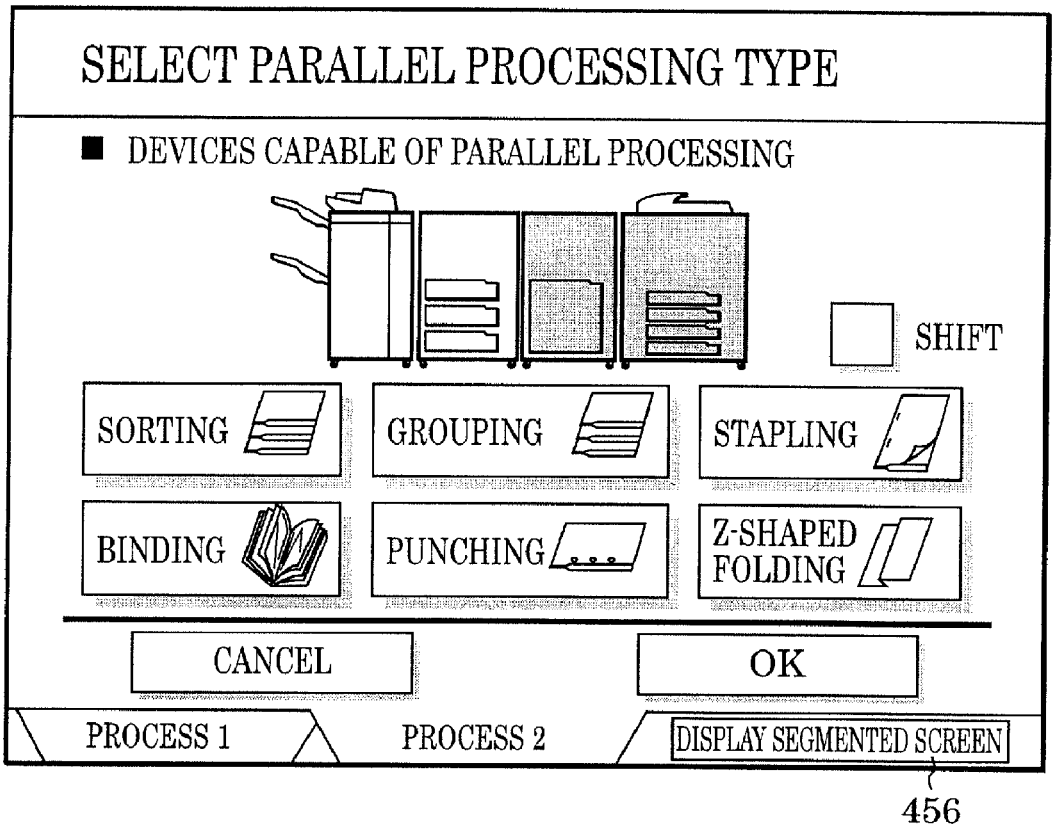
FIG. 25 shows a display screen in the display frame in the sheet-processing system according to the embodiment.

The flow of input operation regarding process 2 performed in parallel processing will now be described by referring to FIG. 14. After selecting parallel processing (Input parallel processing), a screen to select a type of parallel processing is displayed (S1401). That is, a parallel-processing-type select screen shown in FIG. 25 will be displayed in the entire screen. On this screen, a type of process in the sheet-processing devices capable of parallel processing is selected. The user presses an OK button if the selected type is correct. The screen shown in FIG. 25 is a full-screen display for process 2. Alternatively, a sheet-processing type may be selected on the segmented screen for process 2 shown in FIG. 24, which is displayed with the segmented screen for process 1.

Figure 26:
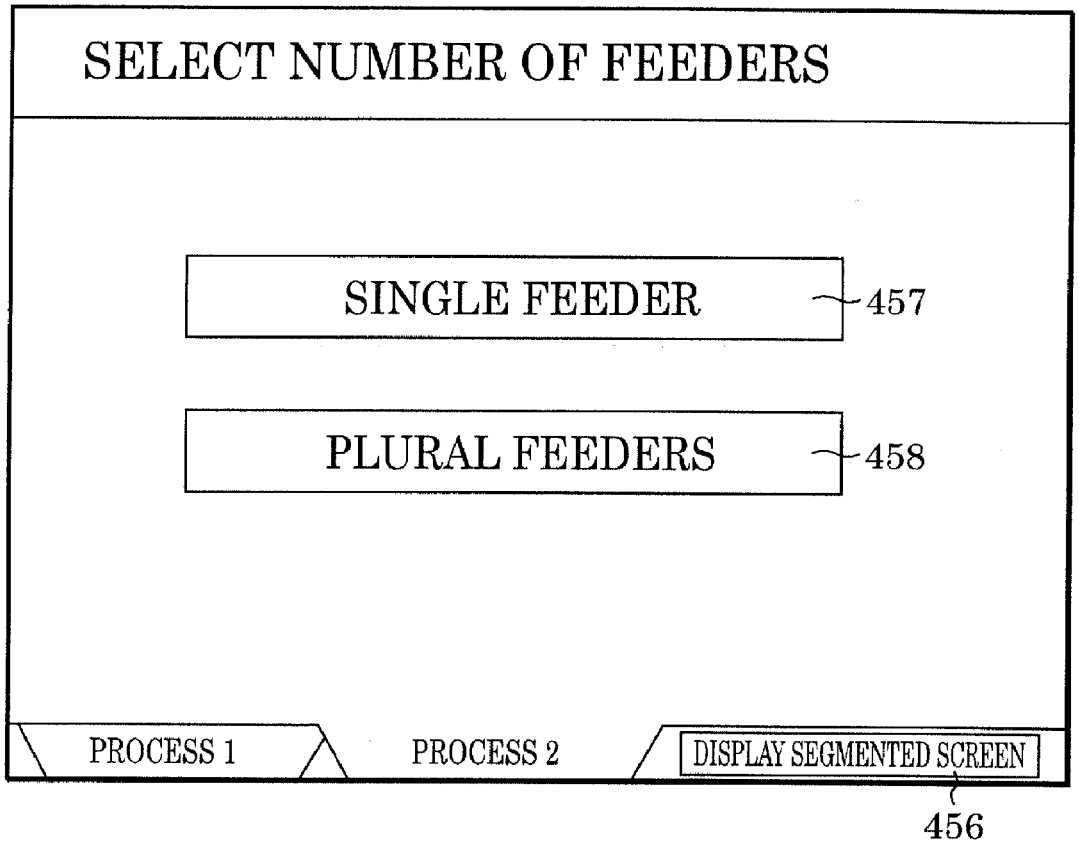
FIG. 26 shows a display screen in the display frame in the sheet-processing system according to the embodiment.

After selecting the OK button on the parallel-processing-type select screen shown in FIG. 25, the screen is changed to a the number-of-feeders select screen shown in FIG. 26 (S1402). On this screen shown in FIG. 26, the number of feeders for process 2 (third job), that is, a single or plural feeders to supply sheets, is specified. When sheets in a bundle are collated in a predetermined order in a sheet cassette of the inserter 600, the sheets are supplied only from a single feeder and thus a single feeder button 457 is selected. When a plurality of bundles of sheets is in different sheet cassettes in the inserter 600 and when each bundle consists of the same sheets which need to be collated, a plural-feeders button 458 is selected. The screen shown in FIG. 26 is a full-screen display for the second job. Alternatively, a sheet-supply-location type may also be selected on the segmented screen for process 2, which is displayed with the segmented screen for process 1.

Figure 27:
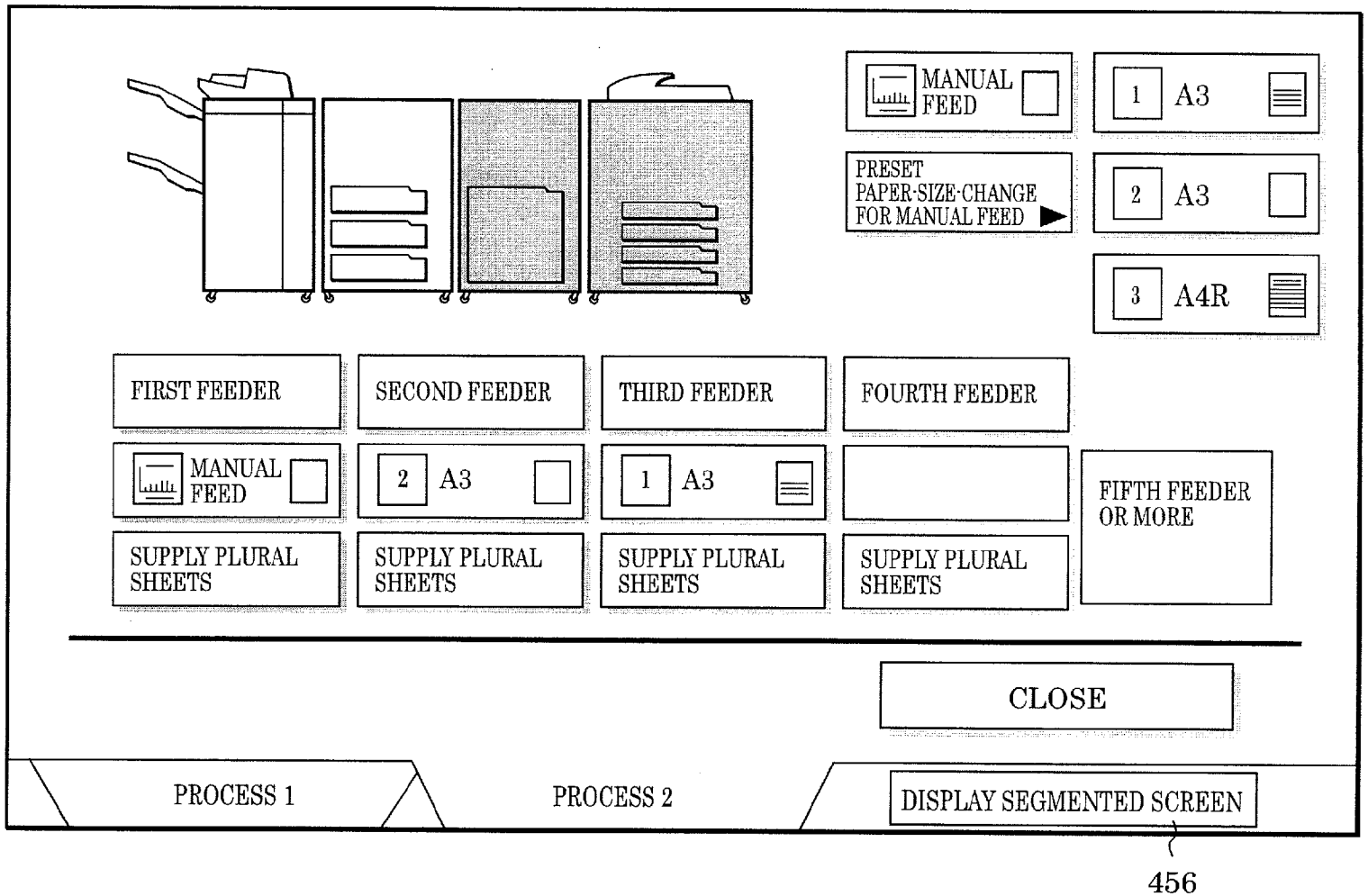
FIG. 27 shows a display screen in the display frame in the sheet-processing system according to the embodiment.

After selecting the number of feeders on the screen shown in FIG. 26, the screen is switched to a sheet-type select screen shown in FIG. 27 (S1403). On the sheet-type select screen, sheet-supply conditions such as the order of supplied sheets, feeder(s) to be used, sheet type, and the number of sheets for each sheet type, are selected. The screen shown in FIG. 27 is a full-screen display for process 2. Alternatively, the sheet-supply conditions may also be selected on the segmented screen for process 2, which is displayed with the segmented screen for process 1.

Figure 28:
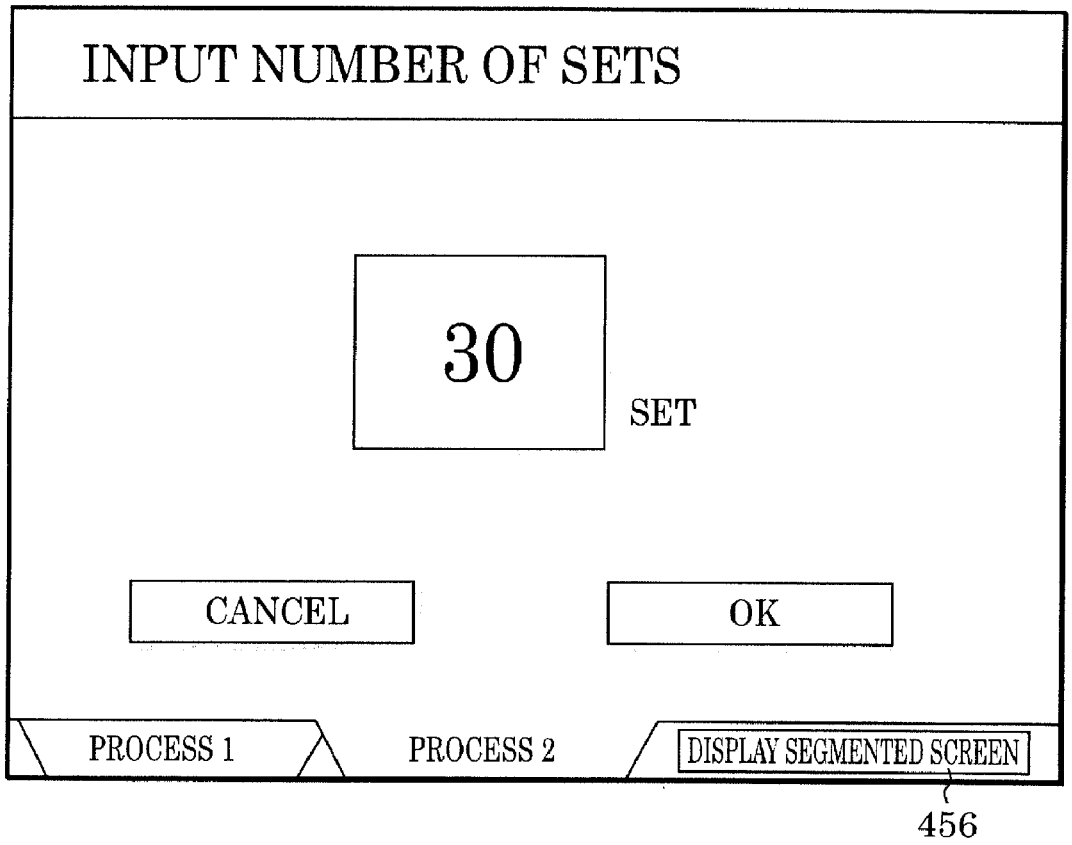
FIG. 28 shows a display screen in the display frame in the sheet-processing system according to the embodiment.

After the sheet-supply conditions are selected in the sheet-type select display shown in FIG. 27 and a close button is pressed, the screen changes to a the-number-of-sets input screen shown in FIG. 28 (S1404). On this screen shown in FIG. 28, the total number of sets to be processed in process 2 is input through the numeric keypad disposed close to the display screen. If the input number is correct, an OK button is pressed.

Figure 29:
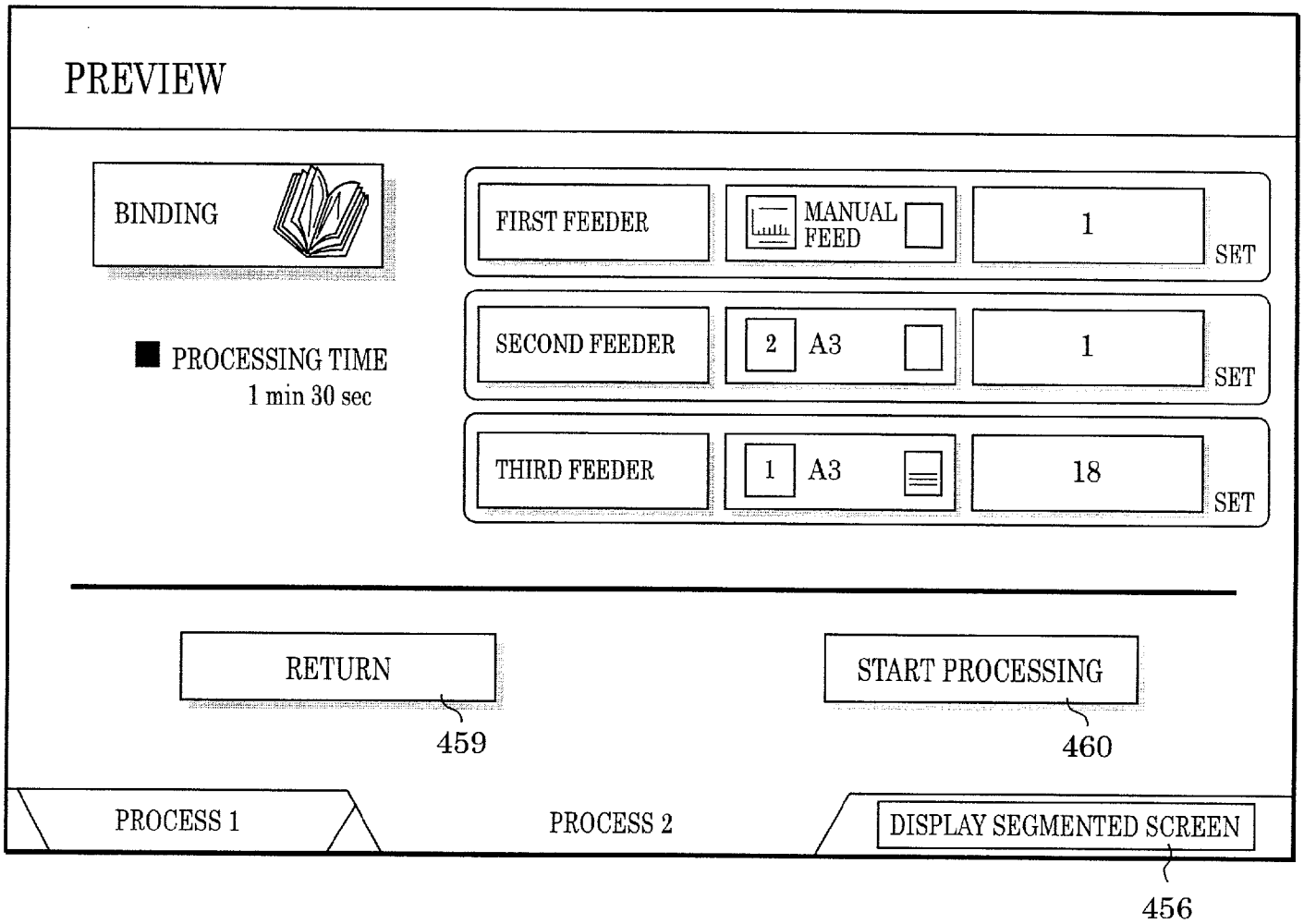
FIG. 29 shows a display screen in the display frame in the sheet-processing system according to the embodiment.

Pressing the OK button on the the-number-of-sets input screen shown in FIG. 28 switches the screen to a preview screen shown in FIG. 29 (S1405). On the preview screen, input settings such as a sheet-processing type, processing time, and sheet-supply settings, are confirmed. If the settings represented on the preview screen need to be modified, a return button 459 is pressed to go back to the previous screen shown in FIG. 28. If the settings are correct, a start-processing button 460 is pressed.

Figure 30:
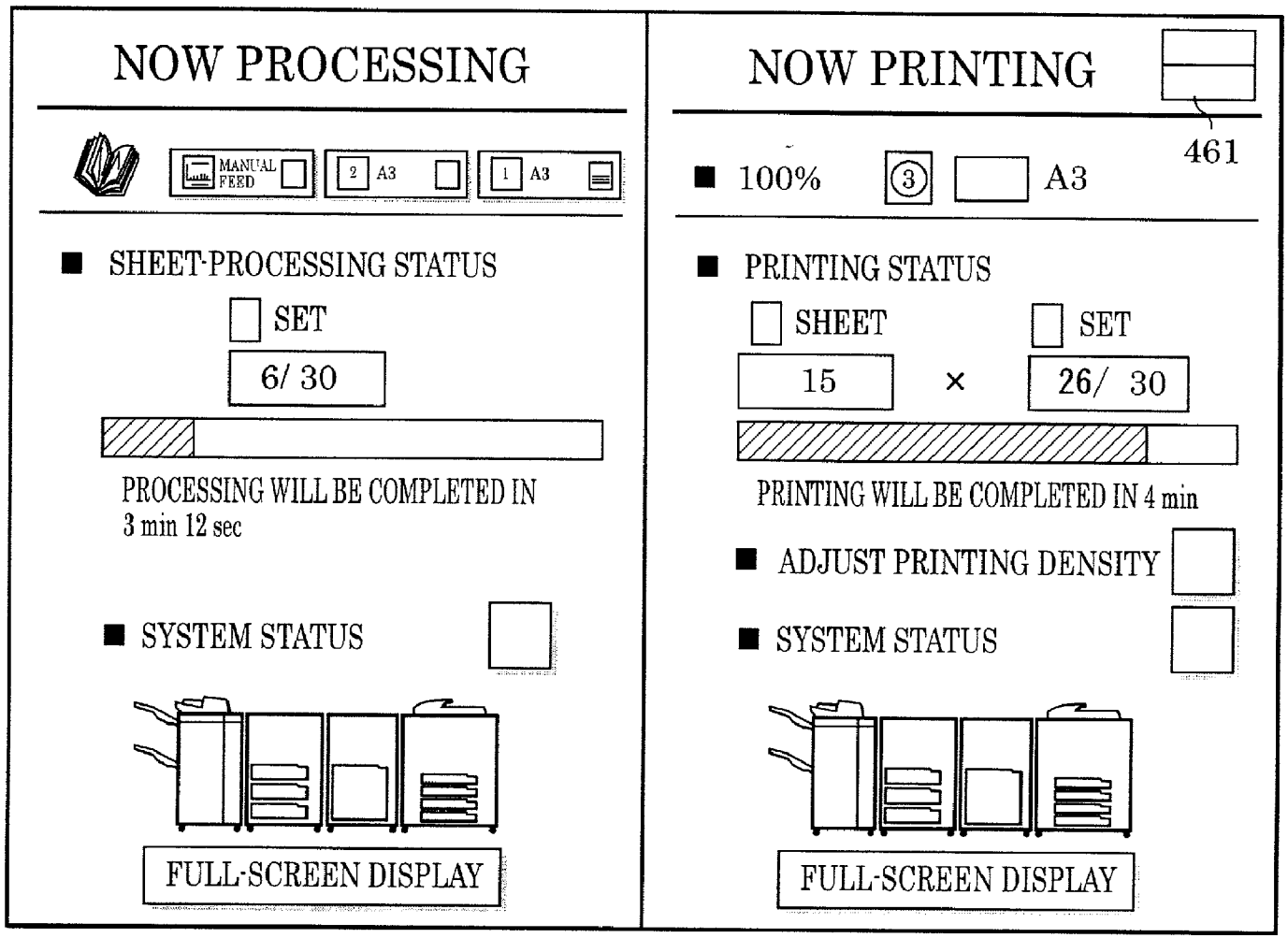
FIG. 30 shows a display screen in the display frame in the sheet-processing system according to the embodiment.

When the start-processing button 460 is selected on the previous screen shown in FIG. 29, process 2 is started in parallel with process 1, and the screen is changed to a parallel-processing screen shown in FIG. 30 (S1406). The parallel-processing screen shown FIG. 30 appears when process 1 (second job) and process 2 (third job) are simultaneously processed. Similar to when selecting the parallel processing, the screen is segmented for each process so that the status of each process can be monitored at the same time.

A screen-segmentation-change button 461 is provided at the top corner of the laterally-segmented screens shown in FIG. 30. Pressing the screen-segmentation-change button 461 switches the laterally-segmented screens to vertically-segmented screens shown in FIG. 31. Considering physically challenged individuals such as users in wheel chairs, the operation display 400 may be disposed at a lower position, whereby usability of the system can be improved.

Figure 31:
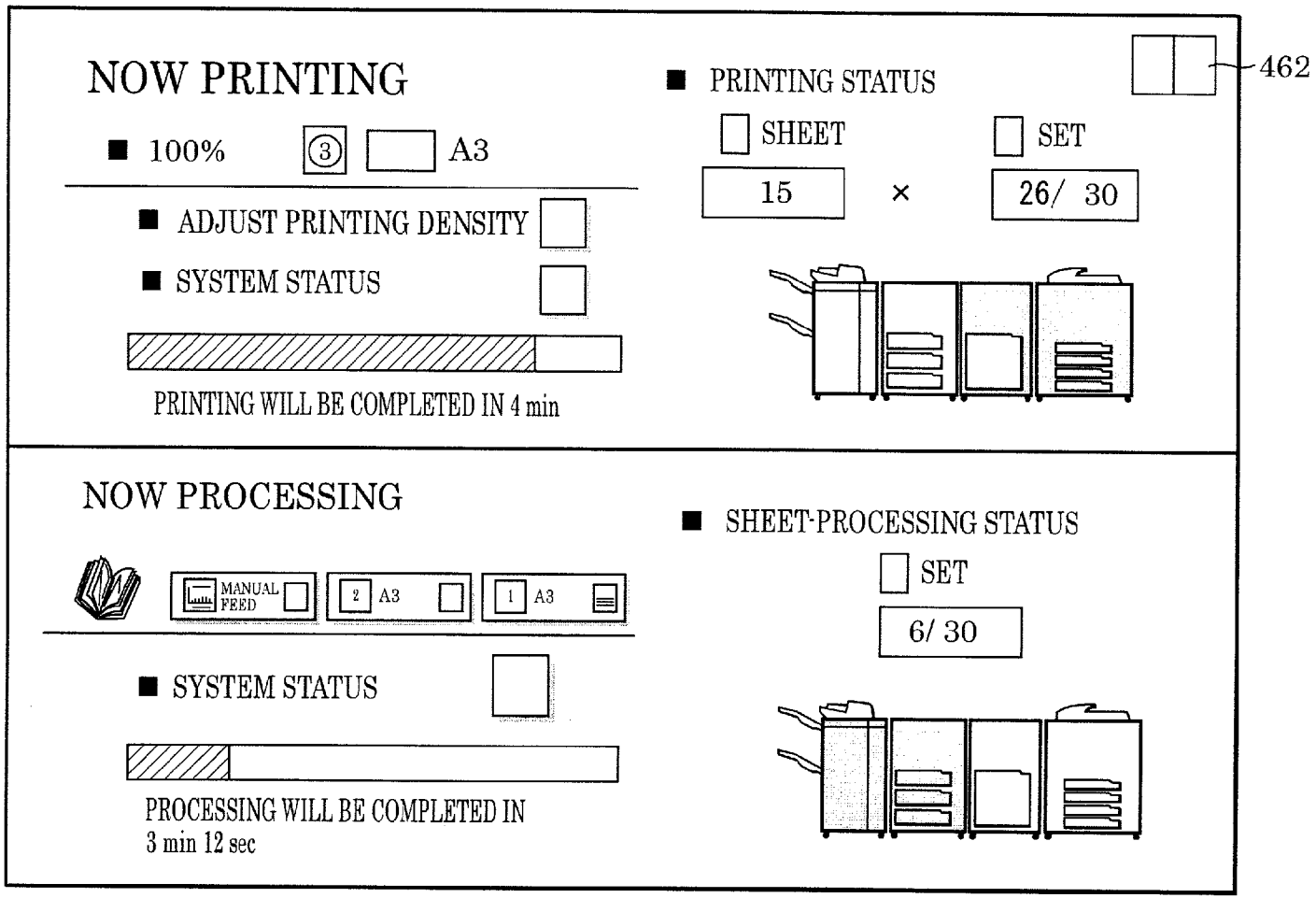
FIG. 31 shows a display screen in the display frame in the sheet-processing system according to the embodiment.

When a screen-segmentation-change button 462 is selected on the screen shown in FIG. 31, the screen is switched back to the laterally-segmented screen shown in FIG. 30. The parallel-processing screens shown in FIGS. 30 and 31 display processing conditions, the number of sets to be processed, processing time, and the status of the system processing the jobs.

The CPU circuit 150 monitors the system at all times to detect a problem such as a paper jam during the parallel processing (S1407). If the CPU circuit 150 detects a problem, the job is halted and an error screen appears automatically. The error screen shows instructions for the user to address the problem (S1408).

Figure 32:
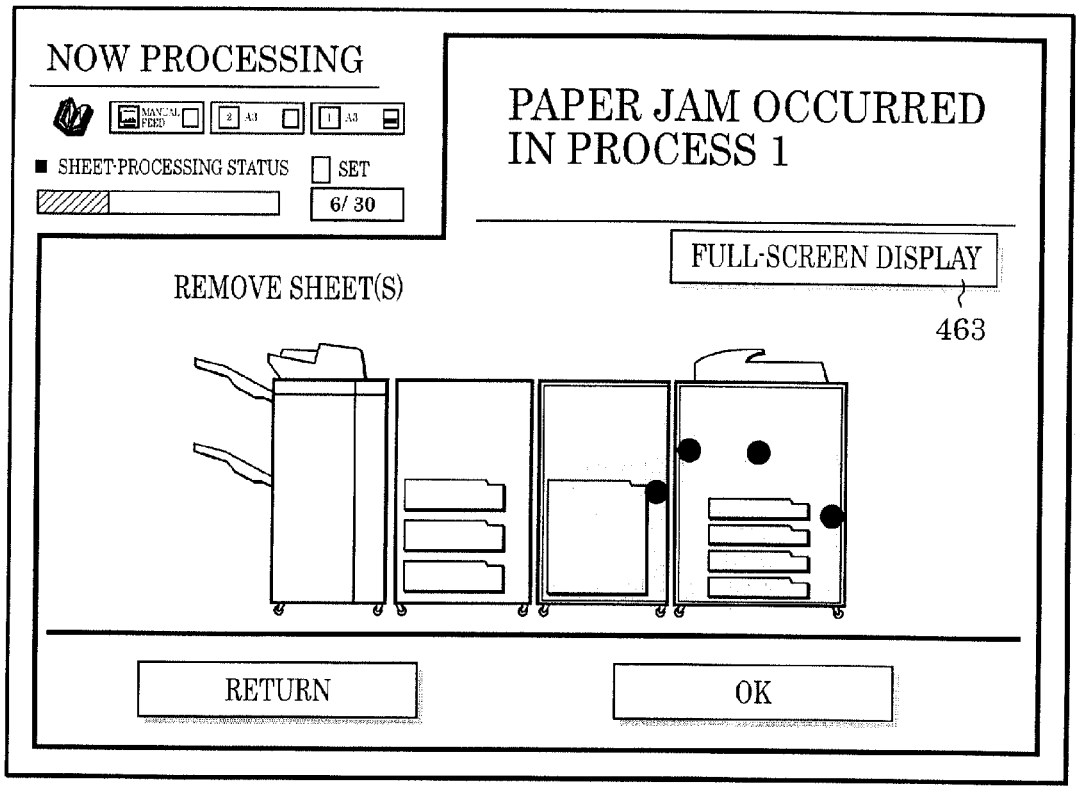
FIG. 32 shows a display screen in the display frame in the sheet-processing system according to the embodiment.
Figure 33:
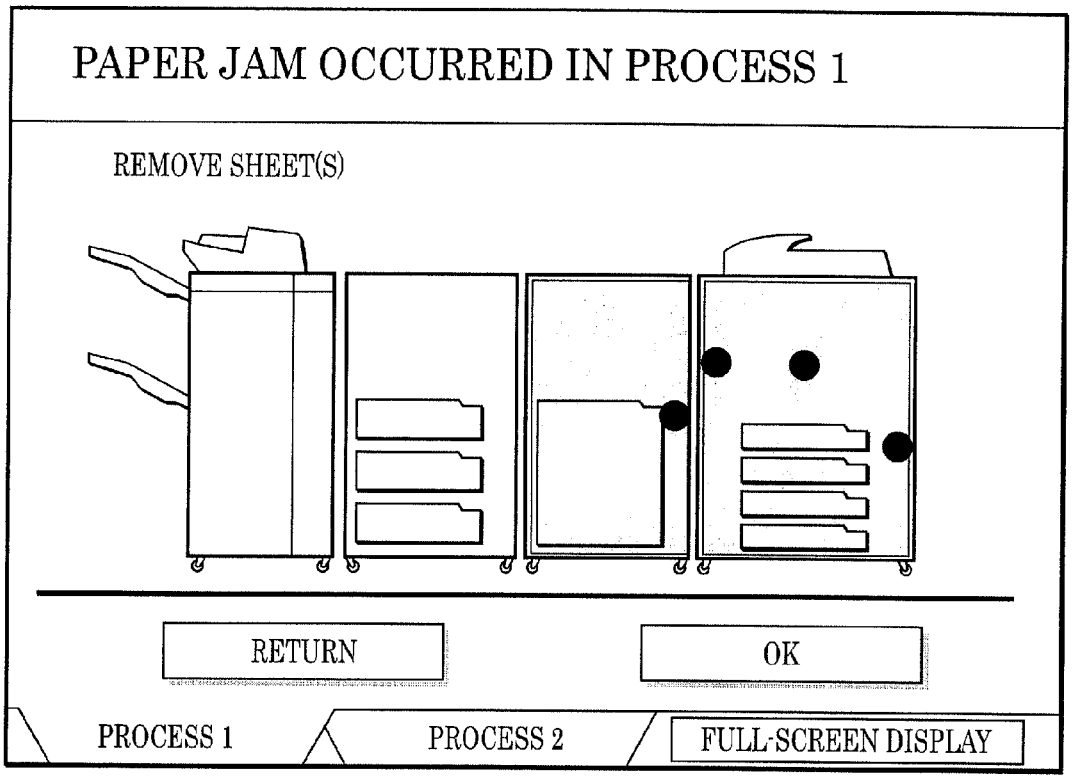
FIG. 33 shows a display screen in the display frame in the sheet-processing system according to the embodiment.

Examples of the error screen are described below. FIG. 32 shows a screen when process 1 irregularly stops due to a malfunction caused by a paper jam in process 1 during parallel processing of process 1 and process 2. In this case, a screen for showing instructions to handle the problem for halted process 1 is displayed larger than the processing screen for proceeding process 2. Accordingly, while the minimum information of proceeding process 2 is provided, the user can address the problem in process 1 by referring to the instructions on the larger screen, whereby the problem in process 1 can be handled in a more effective manner. Alternatively, by selecting a full-screen display button 463 on the screen shown in FIG. 32, only the screen for halted process 1 with tabs to switch screens between process 1 and process 2 may be displayed on the entire display screen, as in FIG. 33.

Figure 34:
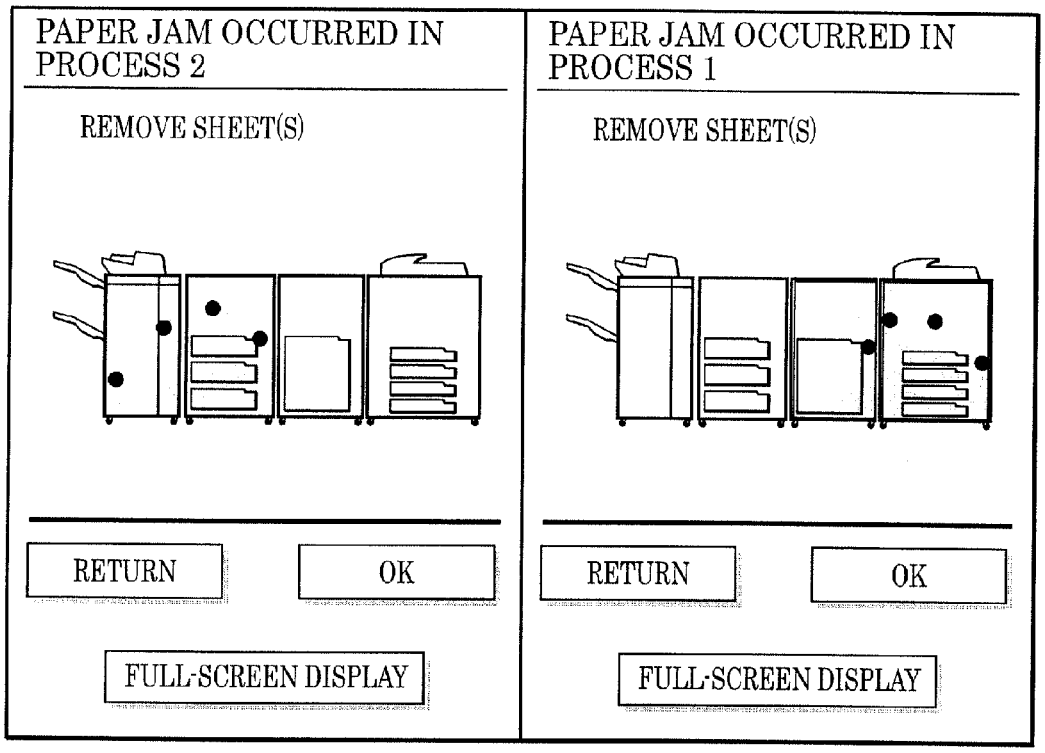
FIG. 34 shows a display screen in the display frame in the sheet-processing system according to the embodiment.

FIG. 34 shows a screen when both process 1 and process 2 irregularly stop due to malfunctions caused by paper jams in process 1 and process 2. When a problem in one process is solved, the process is resumed and the screen is changed to either the screen in FIG. 32 or the screen in FIG. 33. When a problem in the other process is solved and this process is also resumed, the screen is changed to either the screen in FIG. 30 or the screen in FIG. 31. When the problem is solved in each error screen, one of the display screens shown in FIGS. 30 to 33 appears, and the interrupted processes are resumed.

Figure 35:
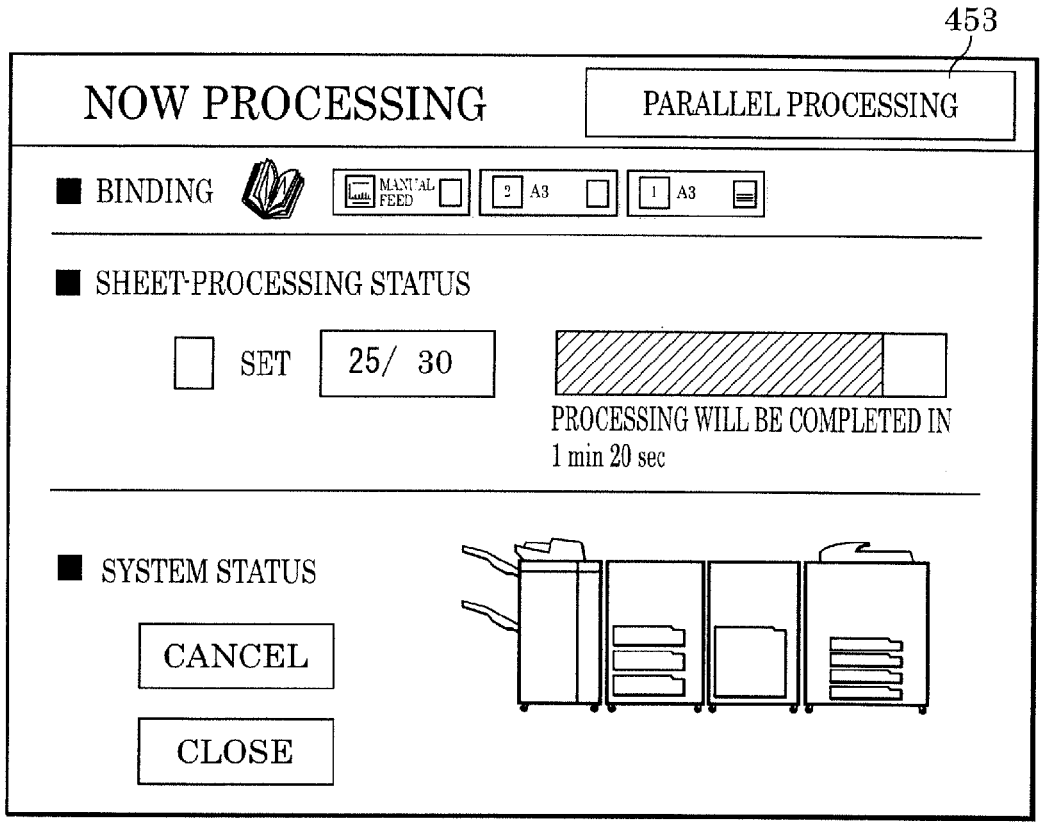
FIG. 35 shows a display screen in the display frame in the sheet-processing system according to the embodiment.

Thereafter, one job is completed (S1409). When one job (process 1) is successfully completed, the screen is automatically switched to a full-screen display for the process 2 and the parallel-processing button 453 appears on the screen (S1410), as shown in FIG. 35.

Figure 36:
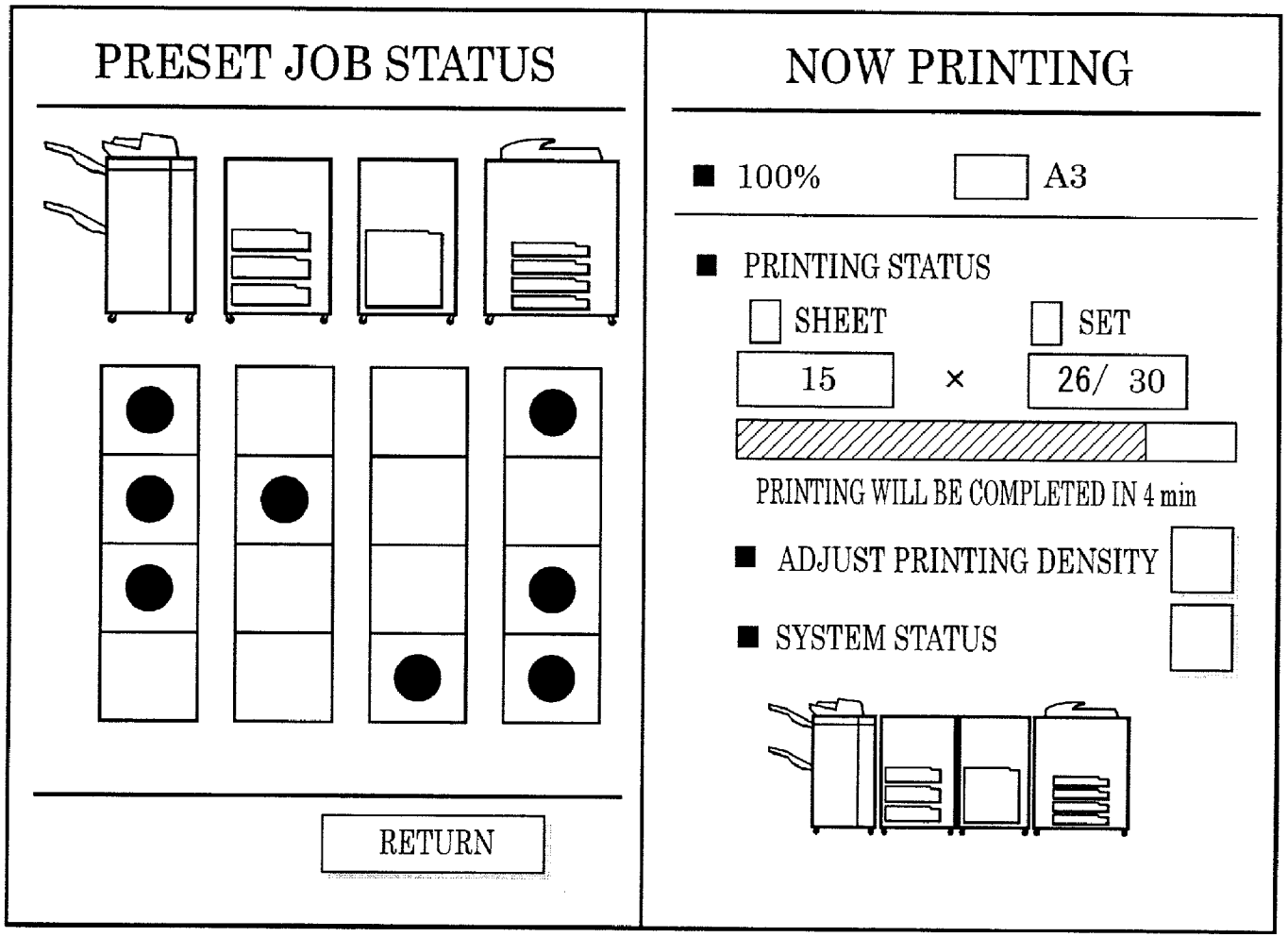
FIG. 36 shows a display screen in the display frame in the sheet-processing system according to the embodiment.
Figure 37:
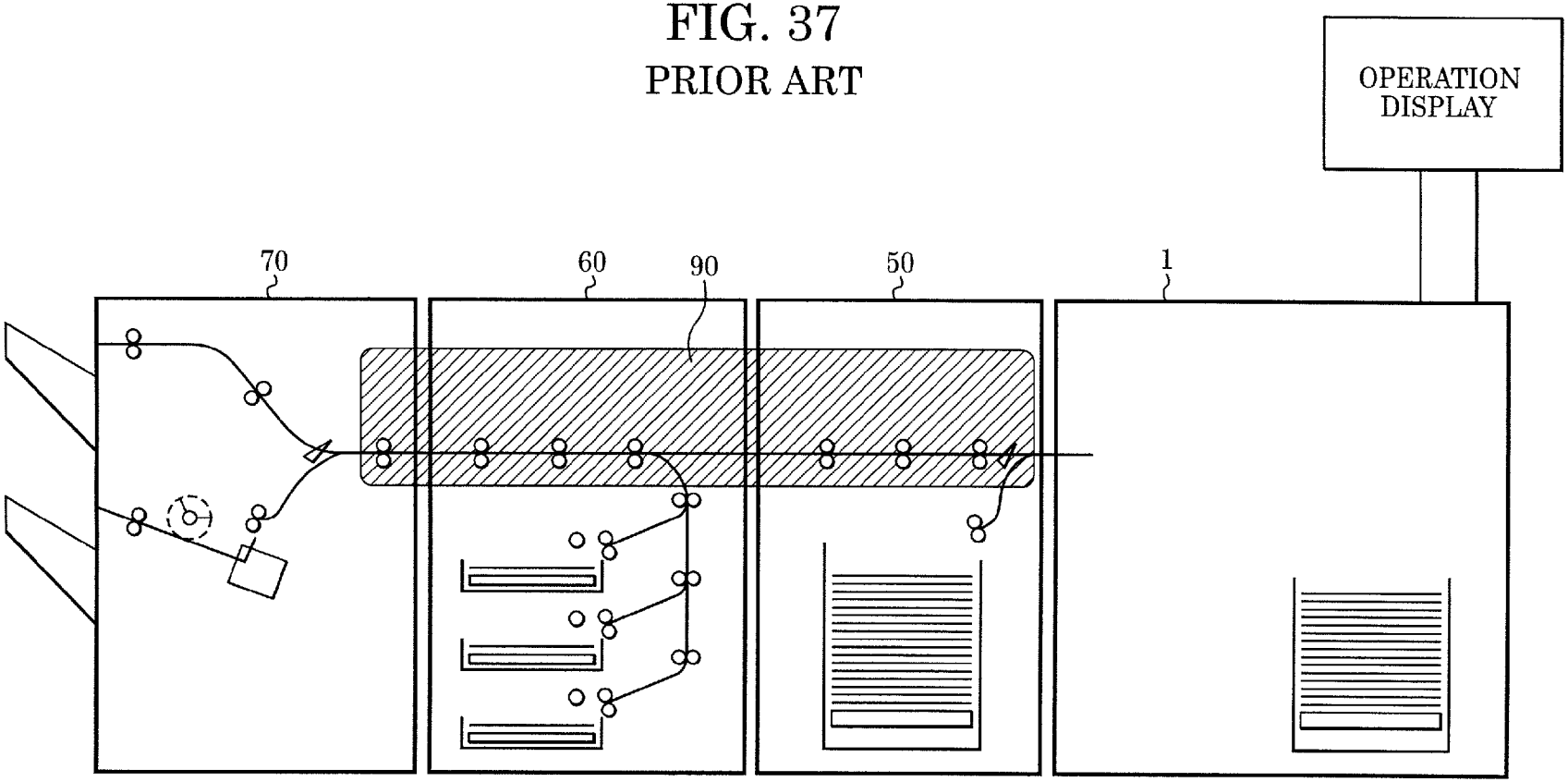
FIG. 37 PRIOR ART
FIG. 37 is a schematic view of a known sheet-processing system.

In the above embodiment, only when parallel processing can be performed, the parallel-processing button 453 is displayed. Alternatively, a job may be preset even when the parallel processing cannot be performed at the moment. FIG. 36 shows segmented screens, one for a screen for the status of sheet processing and the other one for the status of preset jobs. That is, the segmented screens are not only used for the screens for the jobs processed in parallel but also for the screen for the status of proceeding sheet processing and the screen for the status of preset jobs, as shown in FIG. 36. During parallel processing, a screen can be switched to the segmented screens for the status of proceeding parallel processing and the status of preset jobs.

The above-described embodiment is summarized below.

(1) The sheet-processing system A according to the present embodiment includes a plurality of sheet-processing devices (the image formation device 10, the stacker 500, the inserter 600, and the finisher 700), which have different sheet-processing functions and the display (operation display 400), and the system executes a job per unit for sheet processing with at least one of the sheet-processing devices. In this sheet-processing system A, when a plurality of jobs are processed in parallel, the job display screen is segmented in accordance with the number of jobs being processed in parallel, whereby segmented job display screens for the plurality of jobs are displayed simultaneously in the display frame of the display.

(2) According to the sheet-processing system A described in (1), an instruction from a user regarding the job is input on the job display screen while the job is being processed, and an instruction regarding each of the plurality of jobs is input on the job display screen while the plurality of jobs is being processed in parallel.

(3) According to the sheet-processing system A described in (2), an instruction from the user is input on each of the segmented job display screens displayed simultaneously in the display frame of the display.

(4) According to the sheet-processing system A described in (1) to (3), an instruction from a user regarding the job is input on the job display screen, and a parallel-processing job reception key appears on the job display screen in the display when while at least one job is being processed, another job can be performed with at least one sheet-processing device that is not in use for the job being presently processed.

(5) According to the sheet-processing system A described in (4), when the parallel-processing job reception key is input, the job display screen for the job being presently processed and the job display screen for the job to be processed are displayed simultaneously in the display frame of the display.

(6) According to the sheet-processing system A described in (1) to (5), when at least one job is irregularly stopped in parallel processing of the plurality of jobs, the job display screen for the job irregularly stopped is displayed larger than the job display screen for the proceeding job in the display frame of the display.

(7) According to the sheet-processing system A described in (1) to (6), the segmented job display screens in the display frame are arranged in the same manner as the sheet-processing devices are arranged in the sheet-processing system, the sheet-processing devices processing the jobs in parallel.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet-processing system comprising:

a first sheet post-processing device and a second sheet post-processing device being operable independently from the first sheet post-processing device, both of which have a sheet post-processing function;

a display; and controllers configured to execute at least one of a first mode and a second mode, the first mode in which the first sheet processing devices is used and the second sheet processing device is not used to process a sheet, the second mode in which the second sheet processing device is used and the first sheet processing device is not used to process a sheet, wherein the controllers cause the display to display information about the first mode and information about the second mode corresponding to positional relation between the first sheet processing device and the second sheet processing device when the controllers execute the first mode and the second mode in parallel.

2. The sheet-processing system according to claim 1, wherein the controller causes the display to display the information about the first mode and not to display the information about the second mode when the controllers execute the first mode and do not execute the second mode in parallel.

3. The sheet-processing system according to claim 2, wherein the controllers change a size of a display area in the display area in the display to display the information about the first mode between when the first mode and the second mode are executed in parallel and when the first mode is executed and the second mode is not executed in parallel.

4. The sheet-processing system according to claim 1, wherein the display is configured such that an instruction from the user regarding the first mode and the second mode can be input, and wherein the instruction regarding the first mode and the second mode to be executed in parallel can be input from the display when the first mode and the second mode are executed in parallel.

5. The sheet-processing system according to claim 4, wherein the display is segmented such that an instruction from a user regarding the first mode and the second mode can be input, and wherein the controllers cause the display to display the information about the first mode and to display a reception key to execute the second mode in parallel when the first mode is executed and the second mode is not executed in parallel.

6. The sheet-processing system according to claim 1, wherein the controllers cause the display to display the information about the first mode being executed and the information about the second mode to be executed, corresponding to positional relation between the first sheet-processing device and the second sheet-processing device, when the reception key to execute the second mode in parallel is selected.

7. The sheet-processing system according to claim 1, wherein, when the controller executes the first mode and the second mode in parallel, and if an error occurs in either one of the first mode and the second mode, the controllers change a size of a display area to display information about the mode in which the error occurs.

8. The sheet-processing system according to claim 7, wherein the display is configured such that an instruction from a user regarding the jobs can be input, and wherein an instruction regarding the second job to be executed in parallel can be input from the display during the execution of the first job.

9. The sheet-processing system according to claim 8, wherein when the display is segmented into job display screens and the job display screens regarding the first processing job and the second processing job are simultaneously displayed, an instruction from the user regarding the first processing job and the second processing job can be input on the display.

10. The sheet-processing system according to claim 7, wherein the display is configured such that an instruction from the user regarding the jobs can be input, and wherein a parallel processing job reception key appears on the display availably while the first job is being executed whereas the second processing job is executable although the second sheet processing device is not in use.

11. The sheet-processing system according to claim 10, wherein the display is segmented so that the job display screen of the first job in process and the job display screen of the second job to be executed are displayed when the parallel processing job reception key is designated.

12. The sheet-processing system according to claim 7, wherein the job display screen regarding the first job is displayed as the display larger than that of the second job when a trouble occurs in the first job while the first job and the second job are executed in parallel.

* * * * *